US010866063B2

(12) United States Patent
Rassias

(10) Patent No.: US 10,866,063 B2
(45) Date of Patent: Dec. 15, 2020

(54) QUICK DETACHABLE AND LOCKABLE HOLSTER

(71) Applicant: John N. Rassias, Boca Raton, FL (US)

(72) Inventor: John N. Rassias, Boca Raton, FL (US)

( * ) Notice: Subject to any disclaimer, the term of this patent is extended or adjusted under 35 U.S.C. 154(b) by 0 days.

(21) Appl. No.: 16/033,440

(22) Filed: Jul. 12, 2018

(65) Prior Publication Data

US 2018/0321014 A1 Nov. 8, 2018

Related U.S. Application Data

(63) Continuation-in-part of application No. PCT/US2017/013667, filed on Jan. 16, 2017.

(60) Provisional application No. 62/279,264, filed on Jan. 15, 2016.

(51) Int. Cl.

| | |
|---|---|
| ***F41C 33/00*** | (2006.01) |
| ***F41C 33/04*** | (2006.01) |
| ***F41C 33/02*** | (2006.01) |

(52) U.S. Cl.
CPC ..... *F41C 33/045* (2013.01); *F41C 33/0263* (2013.01)

(58) Field of Classification Search
CPC ..... F41C 33/045; F41C 33/0263
USPC ..... 224/198
See application file for complete search history.

(56) References Cited

U.S. PATENT DOCUMENTS

| | | | | |
|---|---|---|---|---|
| 5,768,816 | A | 6/1998 | Rassias | |
| 6,149,042 | A | 11/2000 | Rassias | |
| 6,161,741 | A * | 12/2000 | French | F41C 33/0227 224/192 |
| 6,755,331 | B2 | 6/2004 | Rassias | |
| 7,850,053 | B2 | 12/2010 | Rassias | |
| 8,215,525 | B2 | 7/2012 | Rassias | |
| 2002/0148865 | A1 | 10/2002 | French | |
| 2003/0205594 | A1 | 11/2003 | Rassias | |
| 2009/0001117 | A1 | 1/2009 | Rassias | |
| 2015/0267995 | A1* | 9/2015 | Benton | F41C 33/045 224/198 |
| 2015/0323285 | A1* | 11/2015 | McKendrick | F41C 33/045 224/192 |
| 2016/0025451 | A1* | 1/2016 | Morgan | F41C 33/0272 224/198 |

(Continued)

FOREIGN PATENT DOCUMENTS

| | | | |
|---|---|---|---|
| WO | 9918407 | A1 | 4/1999 |
| WO | 2017124072 | A1 | 7/2017 |

*Primary Examiner* — Peter N Helvey
(74) *Attorney, Agent, or Firm* — The Webb Law Firm

(57) ABSTRACT

A holster including a hip plate, a bracket mount detachably engaged with the hip plate, and a shroud for removably receiving a firearm therein and being adjustably connected to the bracket mount, the shroud being angularly adjustable with respect to the bracket mount. The bracket mount may be slidably engaged with the hip plate. The hip plate may define a bracket mount receiving slot, wherein the bracket mount is slidably received within the receiving slot. Also, a strapless shoulder holster may include a hip mount and a shroud for removably receiving a firearm therein and secured to and positioned above the hip mount, wherein the shroud is angularly adjustable about three axes of rotation. The shroud may also be attached to and rotatable about a pivotable stanchion rod extending vertically from and being secured to the mounting bracket. The stanchion rod may also be adjustable in length.

24 Claims, 20 Drawing Sheets

(56) References Cited

U.S. PATENT DOCUMENTS

2019/0219359 A1* 7/2019 Rogers ..... F41C 33/045

* cited by examiner

QUICK DETACHABLE AND LOCKABLE HOLSTER

CROSS-REFERENCE TO RELATED APPLICATIONS

This application is a United States continuation-in-part of International Application No. PCT/US2017/013667 filed Jan. 16, 2017, which claims benefit of U.S. Provisional Patent Application No. 62/279,264 filed Jan. 15, 2016, the disclosures of both of which are hereby incorporated in their entirety by reference.

BACKGROUND OF THE INVENTION

Field of the Invention

The present invention relates to the field of holsters and, in particular, holsters that are detachable, lockable, and holsters that can provide firearm access at a hip or shoulder holster level.

Description of Related Art

Existing shoulder holsters typically are a combination of a leather or nylon pouch for holding a pistol and a series of connecting leather or nylon straps, buckles, snaps, swivels, back joiners, and tie downs. The method of wearing the existing shoulder holster harnesses is to place one arm through the loop of leather or nylon strapping which contains the pistol holster secured to it, and to then put the opposing arm through the second shoulder loop. Once the loops are over both shoulders, each loop is adjusted by tightening each loop strap in relation to the other and buckling them. Both loops are connected to each other by an adjoining back harness which is located at the top of the wearer's back. After both arms have sequentially been placed through their corresponding loops, each tie down is secured to the belt of the wearer on either side of the shoulder loops. At this point, the shoulder holster rig is suspended from both shoulders with the loaded pistol contained in its holster hanging from the loose fitting series of straps, buckles, snaps, and swivels connected to the tie downs which can, and do, move loosely as the wearer sits, walks, or runs.

As existing shoulder holster rigs are thus loosely suspended, the position of the pistol is constantly changing, creating not only a change in the loaded handgun's position and accessibility, but also creating discomfort to the back and shoulders. For those not experienced in the wearing of a shoulder holster rig, it is akin to wearing a small backpack with weights under both armpits, a truly memorable and uncomfortable experience. Although carrying a loaded pistol in such a rig is dangerous, cumbersome, uncomfortable, and disruptive of motor memory of the pistol's exact location during a moment of stress and responsive action, those who tolerate the deficiencies of existing shoulder holster rigs do so to conceal that they are carrying a pistol and no safer or better method of carry is currently available.

To add further to the deficiencies of existing shoulder holster rigs, when the wearer withdraws his pistol, depending on whether he has a vertical or horizontal shoulder rig, he must pull up vertically or pull horizontally, respectively, to remove the pistol. In so doing, the pulling action against the tightness of the holster may rotate the shoulder loop, suspending the holster and pulling against the joining harness connecting to the opposing shoulder loop. Under such force not only do the shoulder loops rotate, but the belt tie downs may move with the actioning force of the draw so that the holster itself moves to the rear. Thus, in some instances, two hands may be required, one to draw the pistol, the other to grasp the holster so that it does not move while drawing. Additionally, in some instances, two hands may be required to reholster the pistol, one to hold the holster steady, the other to place the pistol into the holster.

Another significant disadvantage relative to the existing shoulder harnesses is that because of the positioning of the holstered pistol, spare magazines are attached to the opposing shoulder loops as a counterweight. This creates an unstable platform when rapidly trying to access a spare magazine during a reloading process. As the spare magazines of conventional shoulder holster rigs are carried under the shooting arm, pulling a spare magazine out of its holster under the shooting arm in order to reload the pistol detracts from the target acquisition or accurate firing under stress.

Typical existing shoulder holsters provide only the option to shoulder holster a firearm. If a user wishes to holster the firearm at his/her hip, a second holster must be owned.

An example of a strapless shoulder holster that attempts to cure some of these deficiencies can be found in U.S. Pat. No. 6,755,331 to Rassias, which is hereby incorporated by reference in its entirety. Another example of a holster is shown in U.S. Pat. No. 8,215,525 to Rassias, which is also incorporated by reference herein in its entirety.

Many holsters, however, also are not capable of being quickly and easily lockable and detachable, meaning they are typically not convenient and easy to assemble and disassemble.

Accordingly, a need exists for a holster assembly to address the above-discussed deficiencies and for ambidextrous, quick detachable and lockable holster that can provide firearm access at a hip or shoulder holster level without the need for excess straps, buckles, snaps, belts, loops, or back joiners.

SUMMARY OF THE INVENTION

An embodiment of a holster may include a hip plate, a bracket mount detachably engaged with the hip plate, and a shroud for removably receiving a firearm therein and being adjustably connected to the bracket mount, the shroud being angularly adjustable with respect to the bracket mount. The bracket mount may be slidably engaged with the hip plate. The hip plate may define a bracket mount receiving slot, wherein the bracket mount is slidably received within the receiving slot. The bracket mount may include a tongue that can be slidably received by the bracket mount receiving slot. The bracket mount tongue may include a lip, and the hip plate may include an opposing lip adjacent the receiving slot, such that the bracket mount tongue lip and the hip plate lip secure the bracket mount to the hip plate in a lateral direction. The bracket mount may also define at least one shroud attachment slot, and the shroud may be secured to the bracket mount by a fastener extending through the shroud attachment slot. A stanchion rod connected to the bracket mount may also be included. The stanchion rod may connect at a first end thereof and extend vertically therefrom, and the shroud may be connected to the stanchion rod at a second end thereof. The stanchion rod may be angularly adjustable with respect to the bracket mount in two directions, and, optionally, the shroud may be rotatable about the stanchion rod. In some embodiments, the stanchion rod may also be adjustable in length. In some embodiments, the shroud may comprise a pivoting boss protruding internally in the shroud, the pivoting boss having a first knob configured to engage an open chamber of a firearm inserted into the shroud, a second knob configured to abut the slide of the firearm, and a fulcrum secured to the shroud and located between the first knob and the second knob. The pivoting boss may be configured to rotate about the fulcrum such that, as the firearm is inserted into the shroud, contact between the slide of the firearm and the second knob of the pivoting boss causes the first knob of the pivoting boss to engage the open chamber of the firearm. Discharge of the firearm is prevented, even if a round is chambered, because the first knob of the pivoting boss retains the grip and the slide out of battery.

An embodiment of a strapless shoulder holster may include a hip mount and a shroud for removably receiving a firearm therein and secured to and positioned above the hip mount, wherein the shroud is angularly adjustable about three axes of rotation. The shroud may be axially moveable along one of the three axes of rotation. The strapless shoulder holster may include a shroud secured to the hip mount through a mounting bracket that is detachably engaged with the hip mount. The shroud may also be attached to and rotatable about a stanchion rod extending vertically from and being secured to the mounting bracket, and the stanchion rod may be pivotable about the mounting bracket in two directions. The stanchion rod may also be adjustable in length. The stanchion rod may include an internally threaded rod member defining a threaded internal channel and an externally threaded screw at least partially inserted into the threaded internal channel and threadably engaged with the internally threaded member therein. The shroud may also be rotatably attached to the externally threaded screw. In some embodiments, a stanchion shroud mount may include a lower portion, and an upper portion removable from the shroud independently of the lower portion and configured to cover a sight hole in the shroud. In other embodiments, a stanchion shroud mount may include a lower portion, and a sight guard removable from the shroud independently of the lower portion and configured to cover a sight hole in the shroud and to receive a sight of a firearm holstered in the shroud. In some embodiments, the shroud comprises a pivoting boss protruding internally in the shroud, the pivoting boss having a first knob configured to engage an open chamber of a firearm inserted into the shroud, a second knob configured to abut the slide of the firearm, and a fulcrum secured to the shroud and located between the first knob and the second knob.

A method of holstering a firearm may include sliding a bracket mount into a slot defined by a hip mount, positioning a shroud for removably receiving a firearm on the bracket mount, adjusting an angle of the shroud about a first axis of rotation extending through the bracket mount in a forward and backward direction, releasably securing the shroud to the bracket mount at an angle about the axis of rotation, and securing a firearm in the shroud. The method may also include adjusting a vertical position of the shroud, wherein the shroud is secured at a height entirely above the hip plate, and/or adjusting an angle of the shroud about a second axis of rotation extending substantially horizontally, perpendicular to the first axis of rotation. The method may further include rotating the shroud about a substantially vertical axis of rotation that intersects the first and second axes of rotation. The firearm may include a muzzle end, grip, slide, receiver, and chamber, wherein securing the firearm in the shroud includes exerting a downward force on the firearm grip such that a muzzle end of the firearm slide contacts a muzzle end of the shroud; continuing downward force after contacting the muzzle end of the shroud such that the firearm receiver continues downward motion while the slide remains stationary; opening the firearm chamber; rotating the firearm into the shroud; and engaging the open chamber with a locking member protruding internally in the shroud. Rotating may include rotating a red dot sight into a hole defined in a top of the shroud. Securing the firearm in the shroud may include the step of inserting a tactical pin into a hole defined through a trigger guard panel extending from the shroud. Securing the firearm in the shroud may include the step of inserting a key-lockable tactical pin into a hole defined at a rear of the shroud. Securing the firearm in the shroud may also include the step of securing a firearm including a laser aiming module without detachment of the laser aiming module from the firearm. In some embodiments, the locking member may include a pivoting boss having a first knob configured to engage the open chamber of the firearm, a second knob configured to abut the slide of the firearm, and a fulcrum secured to the shroud and located between the first knob and the second knob.

The embodiments discussed herein may provide a user with an ambidextrous, quick detachable, and lockable holster that can provide firearm access at a hip or shoulder holster level without the need for excess straps, buckles, snaps, belts, loops, or back joiners. The embodiments of the present disclosure provide significant advances in safety, speed of drawing and reholstering, as well as being able to micro-adjust the shown holsters to the specifics of a user's body, preferences, and strong side hand. The disclosed embodiments are ambidextrous in assembly and permit a firearm to be drawn from either hand, regardless of holster positioning, from the locked position. For example, a user may have a firearm holstered on his/her right side, but the described embodiments may permit the user to draw the firearm with either the user's right or left hand, such as permitted by the holstering and drawing mechanisms and methods shown and described in U.S. Pat. No. 6,755,331 to Rassias and U.S. Pat. No. 8,215,525 to Rassias, both of which are incorporated herein by reference. The disclosed embodiments may also be adjusted to accommodate unencumbered access while wearing body armor or other heavy equipment, including, for example, thigh-mounted units. Further detail will become apparent upon review of the attached drawings and accompanying descriptions.

DESCRIPTION OF THE INVENTION

Figure 1:
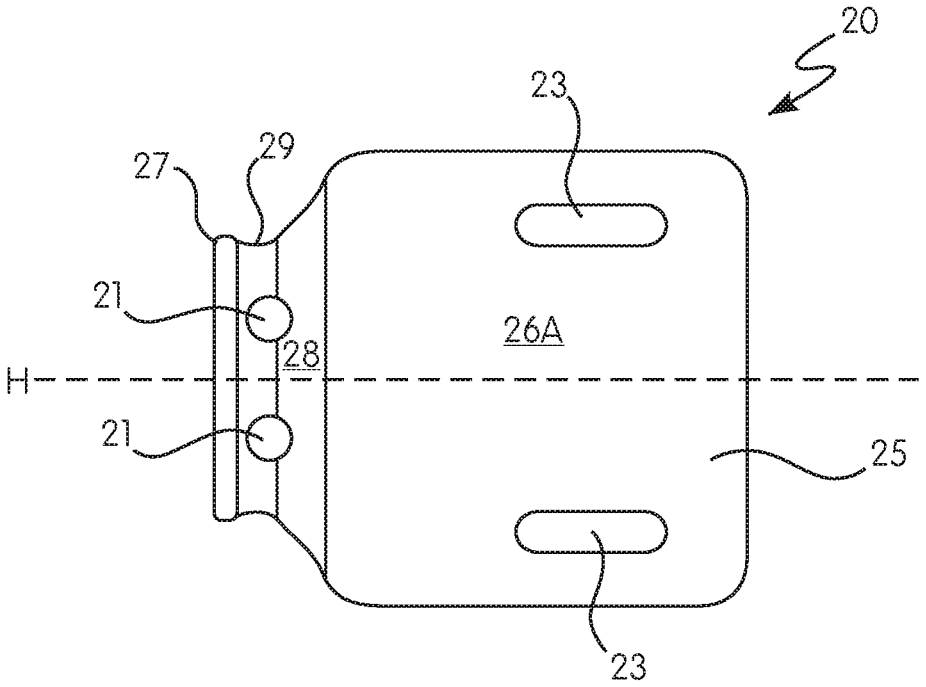
FIG. 1 is a rear view of a bracket mount according to an embodiment of a holster assembly.

As used herein, spatial or directional terms, such as "inner", "outer", "left", "right", "up", "down", "horizontal", "vertical", "lateral", "forward", "backward", "rearward", and the like, relate to the invention as it is shown in the drawing figures. However, it is to be understood that the invention can assume various alternative orientations and, accordingly, such terms are not to be considered as limiting. It is also to be understood that the specific apparatuses and configurations illustrated in the attached drawings, and described in the following specification, are simply exemplary embodiments of the invention. Hence, specific dimensions and other physical characteristics related to the embodiments disclosed herein are not to be considered as limiting, unless otherwise indicated. It is noted that, as illustrated, bracket mount 20 is vertically symmetrical across a horizontal center line, such as broken line H shown in FIG. 1. This configuration, as will become apparent with review of the below description and appended drawings, permits the holster assembly 10 be ambidextrous, not only in drawing and/or holstering a firearm, but also in the manner in which the bracket mount 20 may engage the hip mount 30, which is the same, regardless if mounted in a right-side carry or left-side carry configuration. In particular, the symmetry of lip 27, as also apparent in FIGS. 3A-4B, permits the bracket mount 20 to engage the hip mount 30 in a right-side carry configuration or left-side carry configuration, such that the right-side carry and left-side carry configurations are mirror images of each other.

Figure 2:
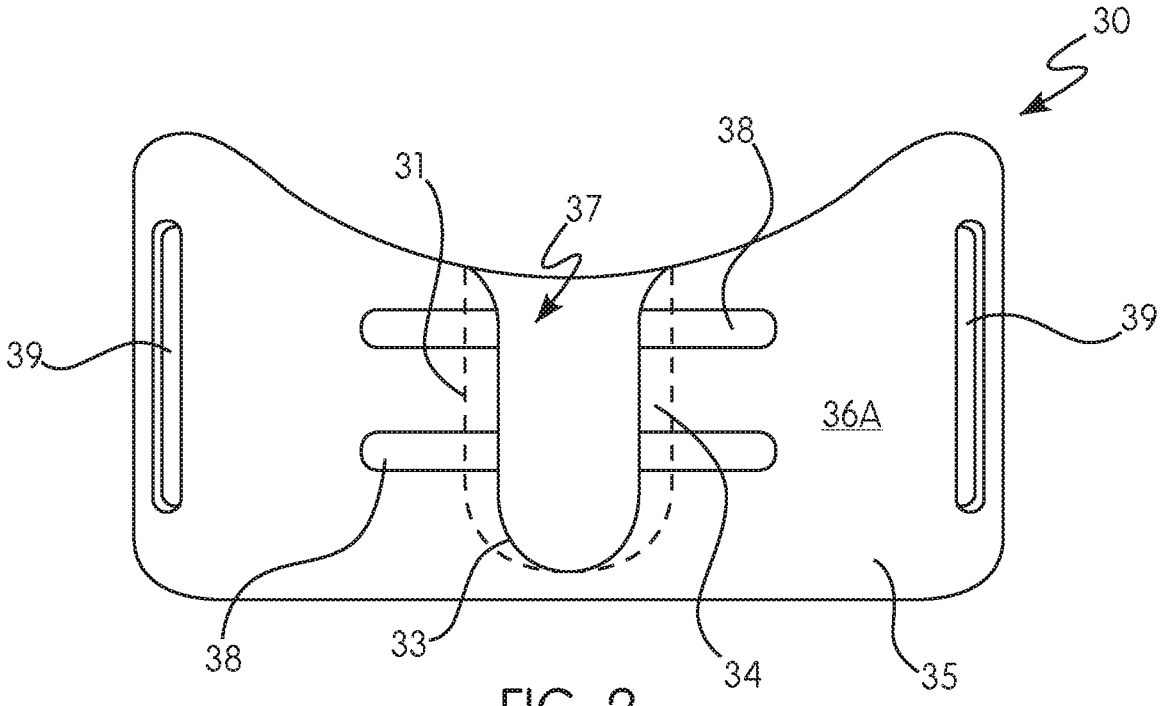
FIG. 2 is a front view of a hip plate according to an embodiment of a holster assembly.

With reference to FIGS. 1-5, an embodiment of a detachable and lockable holster assembly 10 is shown. In FIG. 1, a bracket mount 20 is shown. The bracket mount 20 includes a shroud mounting member 25 defining a plurality of slots 23 for securing and locking a holster shroud to the holster mounting member 25. The member 25 includes a rear mounting face 26A and a front mounting face 26B (more clearly shown in FIGS. 6A-7F). The bracket mount also includes a tongue portion 29 including a lip 27. In some embodiments, as presently illustrated, particularly in FIGS. 3A-4B, the bracket mount 20 may include a curving surface 28 that connects and creates a smooth transition between mounting member 25 and tongue 29. The bracket mount 20 may also include holes 21, which may be defined through tongue portion 29, for locking the bracket mount 20 to a hip plate 30, as shown in FIG. 2.

Referring now to FIG. 2, an embodiment of the holster assembly 10 may include a hip plate 30. The hip plate 30 may include a front face 36A intended to be facing away from a user's body. The plate 30 also includes a rear face 36B (shown more clearly in FIGS. 3A-4B), which, in use, would face and/or abut against a user's body. The front face 26 defines an opening 33, which, as illustrated, may be substantially U-shaped, having a side wall 32. The opening 33 opens into a receiving slot 37 defined in the plate body 35 for receiving and securing the bracket mount 20 therein. The receiving slot 37, as depicted, is also substantially U-shaped. The slot 37 is configured so as to releasably receive the lip portion 27 of tongue 29 of bracket mount 20, as can be more clearly seen in FIGS. 3A-5. The slot 37 is wider than opening 33 and extend to a slot side wall 31, as indicated by broken line in FIG. 2. In other words, as depicted, the slot 37 extends beyond opening 33 into the plate 30 to a slot wall 31 (shown more clearly in FIGS. 3A-4B). Since slot 37 extends beyond the opening 33, the opening side wall 32 forms a lip 34. When engaged with bracket mount 20, lip 34 opposes lip 27 of bracket mount 20, thereby preventing lateral movement either toward or away from a user's body. The slot side wall 31 would prevent movement in the right and left directions (or if on a user's hip, forward and backward). The hip plate 30 may also include user securing slots 39, which, as illustrated hereinbelow, may receive the belt or other strap of a user. Front face 36 of hip plate 30 also defines locking channels 38, which may be used to lock bracket mount 20 to hip plate 30. The channels 38 may, as illustrated later herein, be used to receive clevis pins extending through the channels 38 and the bracket mount 20, such as through-holes 21.

Figure 3A:
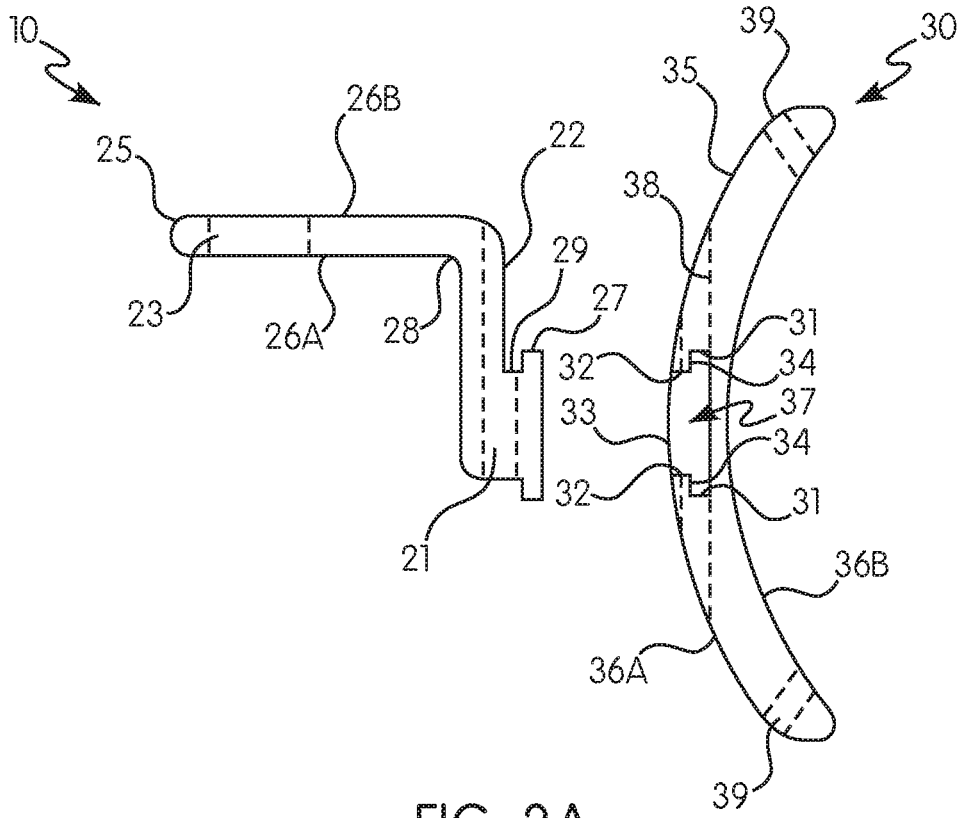
FIGS. 3A-3B are top schematic views of the bracket mount and hip plate of FIGS. 1-2 in a left-side carry configuration.
Figure 3B:
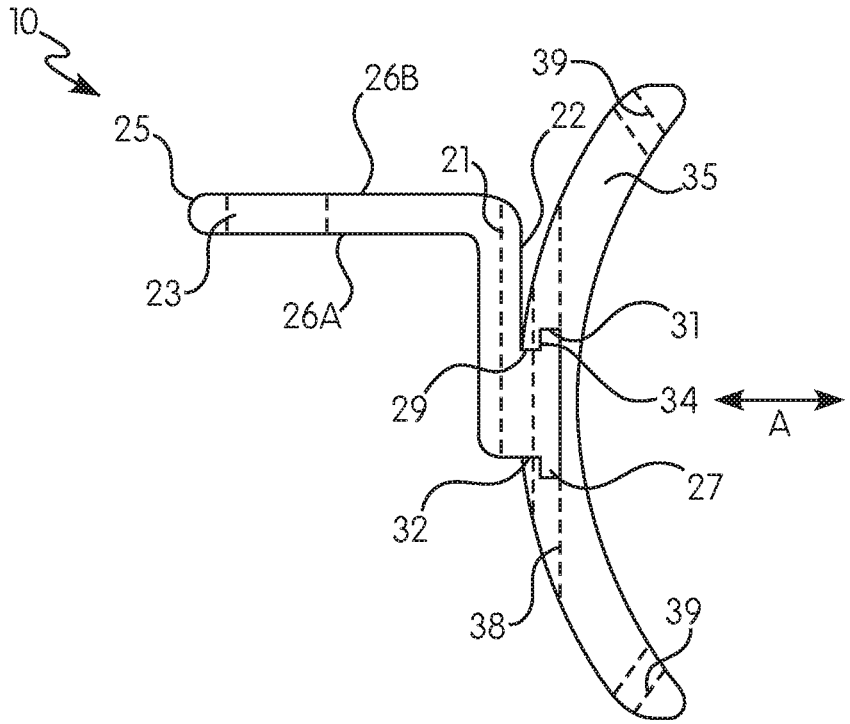

Referring now to FIGS. 3A-3B, top schematic views of the bracket mount 20 and hip plate 30 of a holster assembly 10 according to an embodiment of the invention are shown in a left-side carry configuration. FIGS. 3A-3B illustrate the hip plate 30 and bracket mount 20 in detached and engaged positions, respectively. As more clearly shown in FIGS. 3A-3B, the mounting member 25 may take the form of a substantially S-shaped member, with the tongue portion 29 and mounting member 25 being separated by and at a substantially right angle to a connecting member 22. FIGS. 3A-3B further clearly show that slot 37 extends further into the body 35 of hip plate 30 than side wall 32 of opening 33. The distance between the ends of slot side wall 31 is thus wider than distance between the ends of opening side wall 32 thereby creating lip 34. In other words, slot 37 may have a wider diameter than opening 33. FIG. 3B illustrates how tongue portion 29 of bracket mount 20 would engage hip plate 30 through slot 37. The lip 27 and tongue portion 29 of bracket mount 20 could be slid into slot 37 such that lip 27 and lip 34 abut each other, while tongue portion 29 abuts opening side wall 32. This configuration locks the bracket mount 20 and hip plate 30 in the direction of arrow A. For example, lips 27 and 34 would abut each other and exhibit opposing biasing forces in the direction of arrow A if a force were applied to the holster assembly 10 in that direction. Further, given the substantial S shape of mounting bracket 20, when the bracket 20 is engaged with hip plate 30, such as shown in FIG. 3B, the mounting member 25 may be positioned substantially perpendicular to position to the hip plate 30 such that the front face 26B of the mounting member 25 is forward-facing with respect to a user. Given that the hip plate 30 may not take a straight form and may instead, as illustrated, take the form of a curved structure, substantially perpendicular as used in this context means literally perpendicular or perpendicular to a tangent of a curved hip plate. However, any configuration or construction is contemplated wherein engagement of the hip plate 30 with the mounting bracket 20 results in the front face 26B of mounting member 25 facing forward with respect to the user. The broken lines, as shown in FIGS. 3A and 3B, illustrate the positioning of slots 23 and 39, holes 21, and channels 38.

Figure 4A:
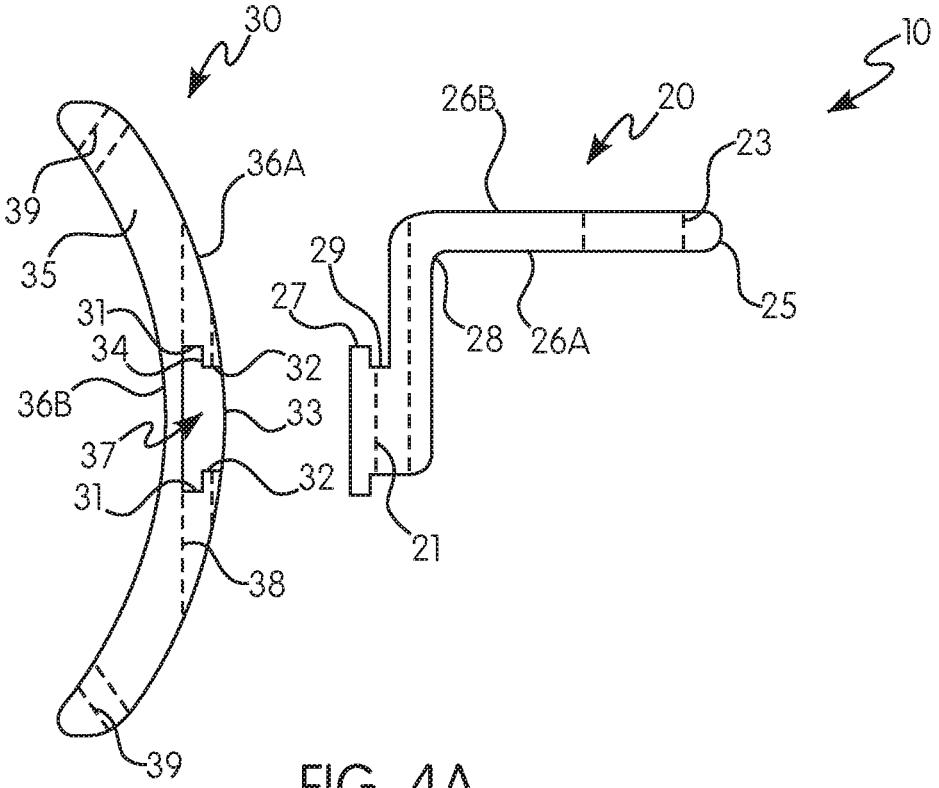
FIGS. 4A-4B are top schematic views of the bracket mount and hip plate of FIGS. 1-2 in a right-side carry configuration.
Figure 4B:
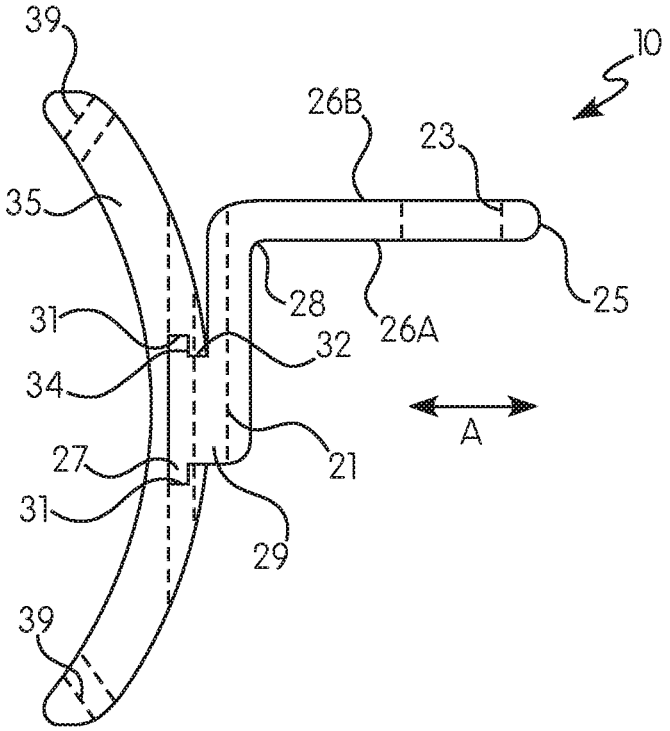

FIGS. 4A-4B top schematic views of the bracket mount 20 and hip plate 30 of a holster assembly 10 according to an embodiment of the invention and are shown in a right-side carry configuration. As such, the use and operation of the holster assembly 10 of FIGS. 4A-4B would be substantially identical to and the mirror image of that shown in FIGS. 3A-3B.

Figure 5:
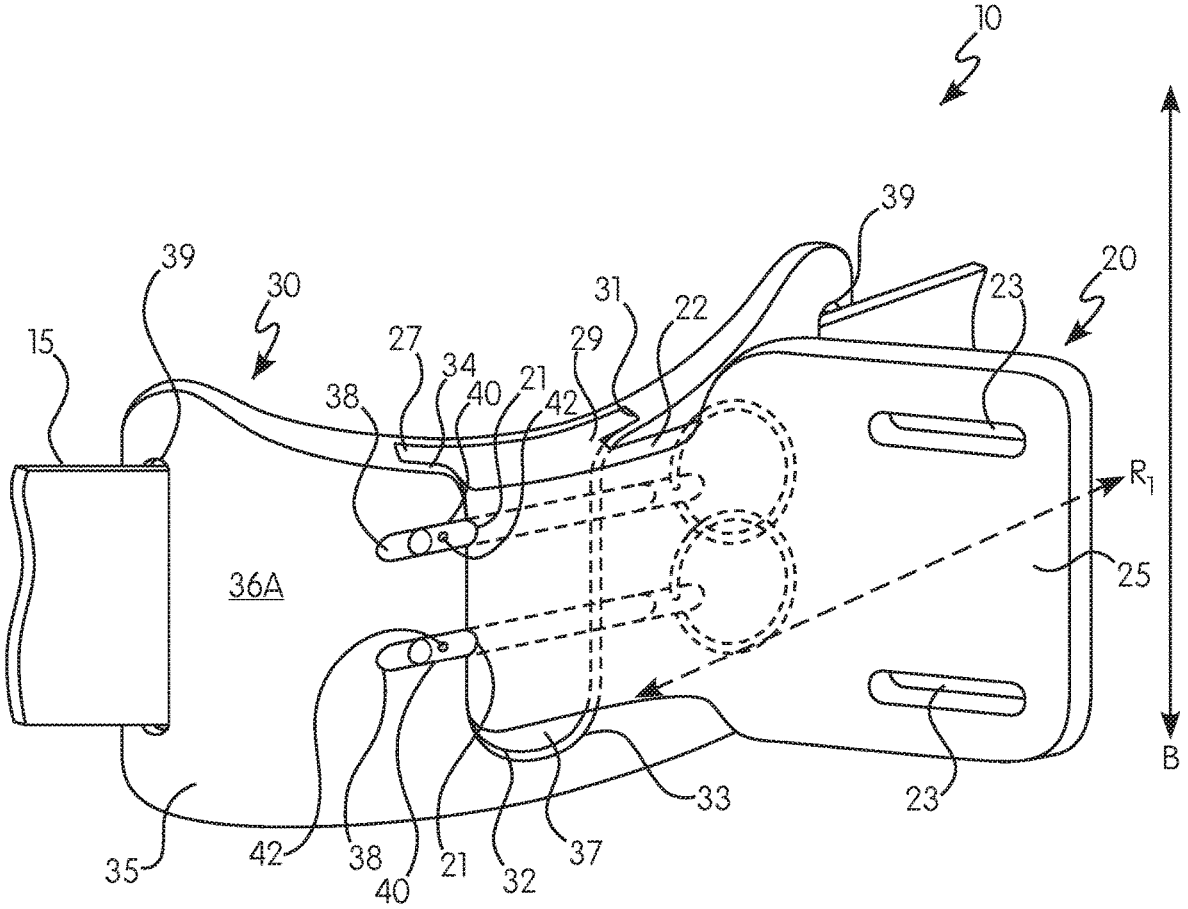
FIG. 5 is a rear perspective view of an embodiment of a holster assembly including the bracket mount and hip plate of FIGS. 1-2 in an engaged configuration in a right-side carry configuration.

Referring now to FIG. 5, an embodiment of holster assembly 10 with a bracket mount 20 fully engaged with a hip plate 30 is illustrated. As shown, and as previously described, when engaged, the bracket mount 20 tongue portion 29 with lip 27 is received inside slot 37 of hip plate 30. The tongue 29 and lip 27 may engage the slot 37 slidably, for example, in the direction of arrow B. As explained previously, by inserting the tongue 29 and lip 27 into the slot 37, the bracket mount 20 and hip plate 30 are secured such in lateral directions due to the abutment of lip 27 with lip 34 and slot side wall 31. As shown in FIG. 5, however, the bracket mount 20 and hip plate 30 may also be secured in a vertical direction. For example, as illustrated, the holster assembly 10 may include clevis pins 40 inserted through holes 21 extending through tongue portion 29 and into locking channel 38 on front face 36A of hip plate body 35. The clevis pins 40 may be detent clevis pins having detents 42, but clevis pins utilizing split pins, as well as any other fastener capable of securing the bracket mount 20 to the hip plate 30, is contemplated. The detents 42 of illustrated clevis pins 40 secure the pins 40 laterally and prevent them from slipping through holes 21 and disengaging the bracket mount 20 from the hip plate 30, while also providing quick release capability by allowing a user to quickly depress the detents and remove the clevis pins, thereby allowing easy and quick detachment of the bracket mount 20 from the hip plate 30 by sliding the tongue 29 and lip 27 upward out of slot 37. FIG. 5 also illustrates that a belt 15 or other strap of a user may be threaded through slots 39 of hip plate 30 for securing the hip plate 30, and, thus, the holster assembly 10, to the user.

Figure 6A:
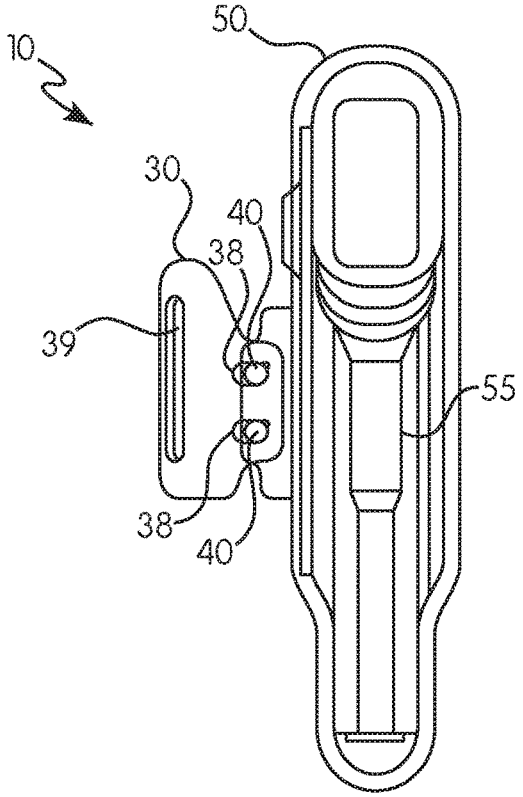
FIG. 6A is a rear view of the holster assembly of FIG. 5 including a firearm shroud with a firearm received therein in a right-side carry configuration.
Figure 6B:
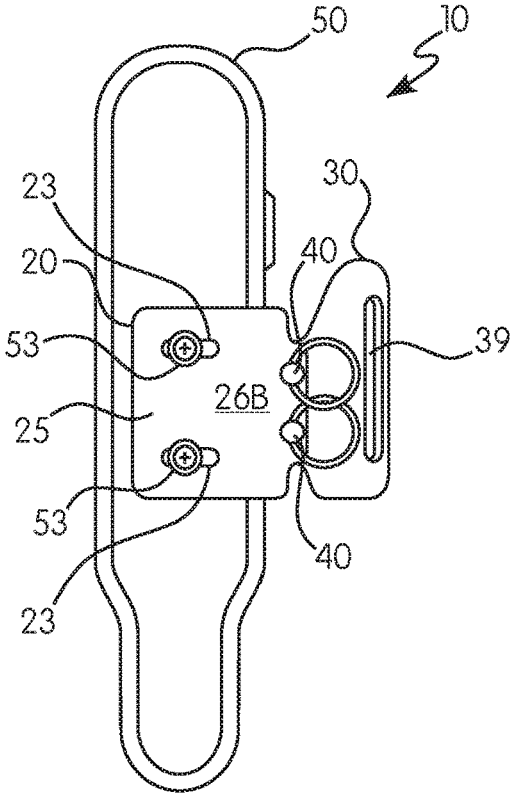
FIG. 6B is a front view of the holster assembly of FIG. 6A.
Figure 6C:
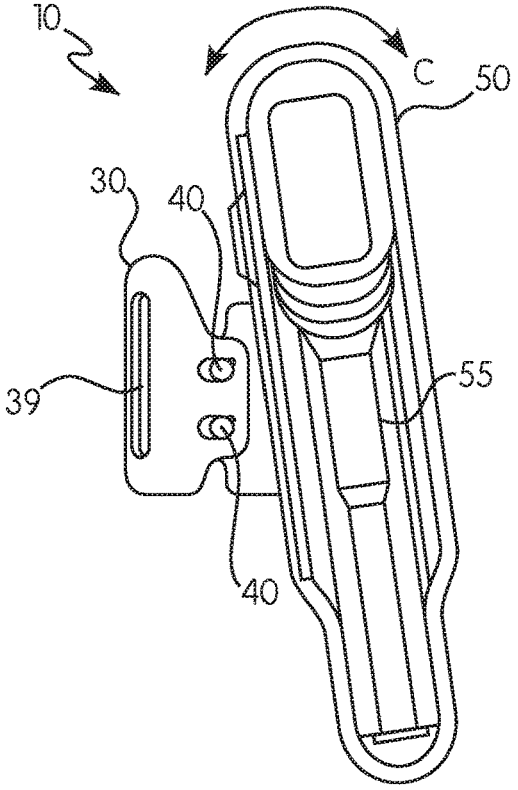
FIG. 6C is a rear view of the holster assembly of FIG. 6A with the shroud positioned in an inward arc configuration.
Figure 6D:
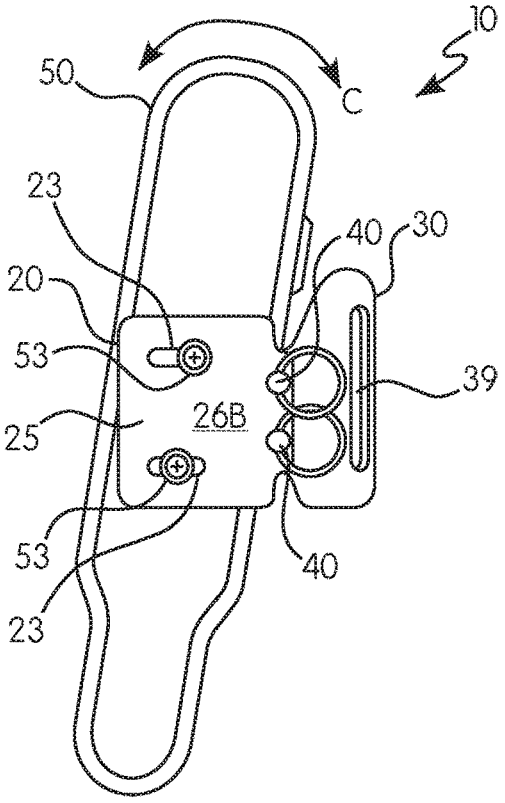
FIG. 6D is a front view of the holster assembly of FIG. 6A with the shroud positioned in an inward arc configuration.
Figure 6E:
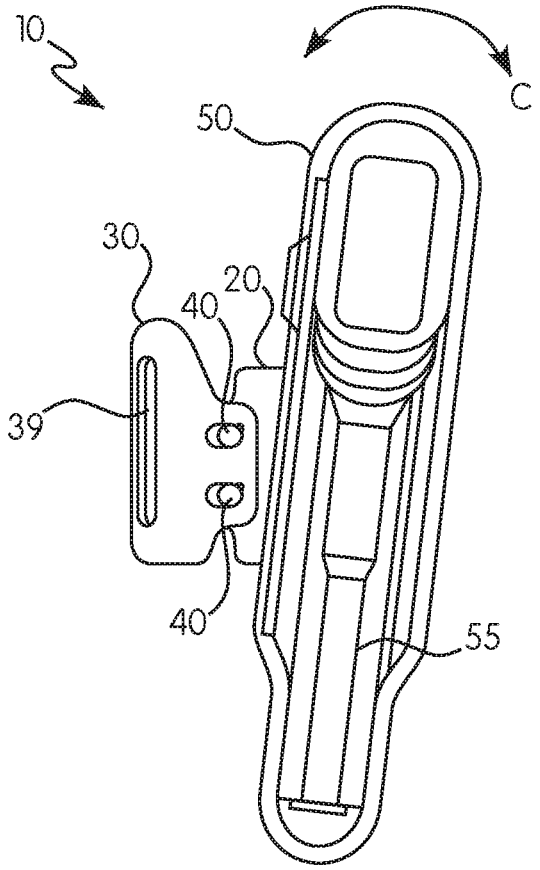
FIG. 6E is a rear view of the holster assembly of FIG. 6A with the shroud positioned in an outward arc configuration.
Figure 6F:
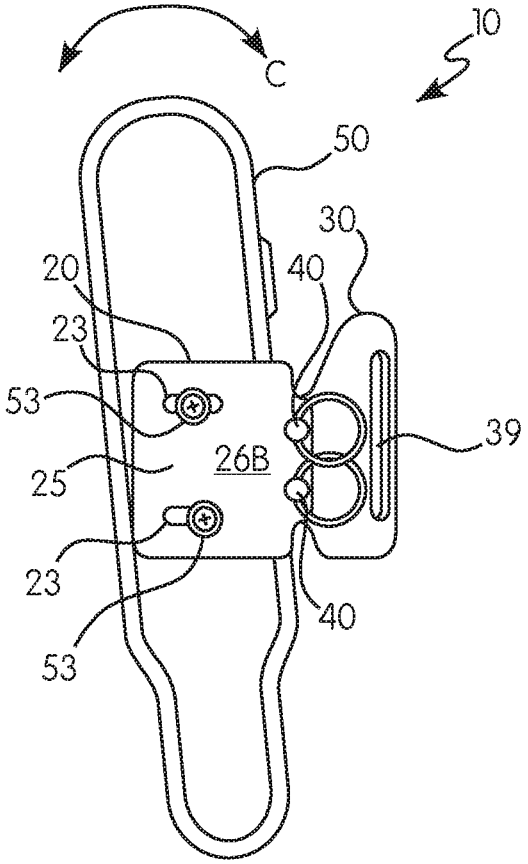
FIG. 6F is a front view of the holster assembly of FIG. 6A with the shroud positioned in an outward arc configuration.

FIGS. 6A-6F illustrate an embodiment of a holster assembly 10 including a shroud 50 for releasably receiving a firearm 55, which, for example, may be a pistol, in a right-side carry configuration. Any shroud capable of releasably receiving a firearm is contemplated by the present invention. For example, but not intending to be limiting, the shroud could be of the type disclosed in U.S. Pat. No. 6,755,331 to Rassias or U.S. Pat. No. 8,215,525 to Rassias, both of which are incorporated herein by reference. FIGS. 6A-6B illustrate the attachment of the shroud 50 to the mounting member 25 of the bracket mount 20. As explained above, mounting member 25 may define a plurality of slots 23 for attachment of the shroud 50. These shroud attachment slots 23 permit fasteners 53 to be inserted therethrough and into the shroud 50 to secure the shroud 50 to the mounting member 25. The fasteners 53 may be a screw and washer arrangement, as presently illustrated. The screws may attach to the shroud 50 through threaded holes positioned thereon, such as illustrated in U.S. Pat. No. 8,215,525 to Rassias, which is incorporated herein by reference. It is contemplated that the shroud 50 may be detachable from the mounting member 25. Thus, any fastener that is adjustable, releasable, and/or at least partially releasable, permitting repositioning and/or removal of the shroud 50 is contemplated by the present invention. As shown, the fasteners 53 may be positioned through the slots 23 such that the shroud is positioned in a substantially vertical direction (see FIGS. 6A-6B). As can be appreciated, the slots 23 may be horizontal and elongated so as to permit positioning of the shroud 50 at different spaced distances from the hip plate 30, e.g., with the fasteners 53 at the most inward position in the slots 23, such that the shroud 50 is close to the hip plate 30, or with the fasteners 53 at the most outward position, such that the shroud 50 is farther from the hip plate 30. As can be appreciated, the fasteners 53 in the slots 23 do not have to be vertically aligned with one another as shown in FIGS. 6D and 6F. They can instead be off set from one another to position the shroud 50 at varying angles inward or outward from the hip plate 30 as indicated by arrow C in FIGS. 6C-6F. For example, FIGS. 6C-6D show an arc inward position, and FIGS. 6E-6F illustrate an arc outward position. In effect, slots 23 and fasteners 53 permit the shroud 50 to be rotatable or pivotable to a certain degree in the direction of arrow C about an axis of rotation extending into front mounting face 26B through mounting member 25, such as represented by broken line R1 in FIG. 5.

Figure 7A:
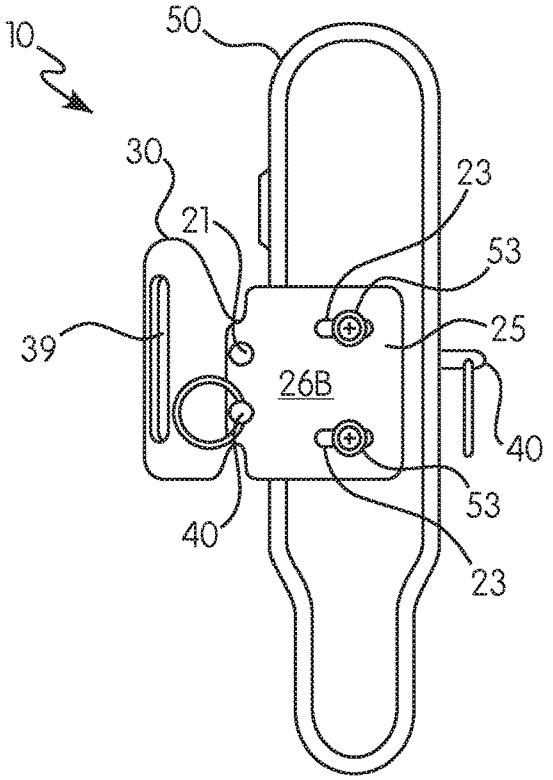
FIG. 7A is a rear view of the holster assembly of FIG. 5 including a firearm shroud with a firearm received therein in a left-side carry configuration.
Figure 7B:
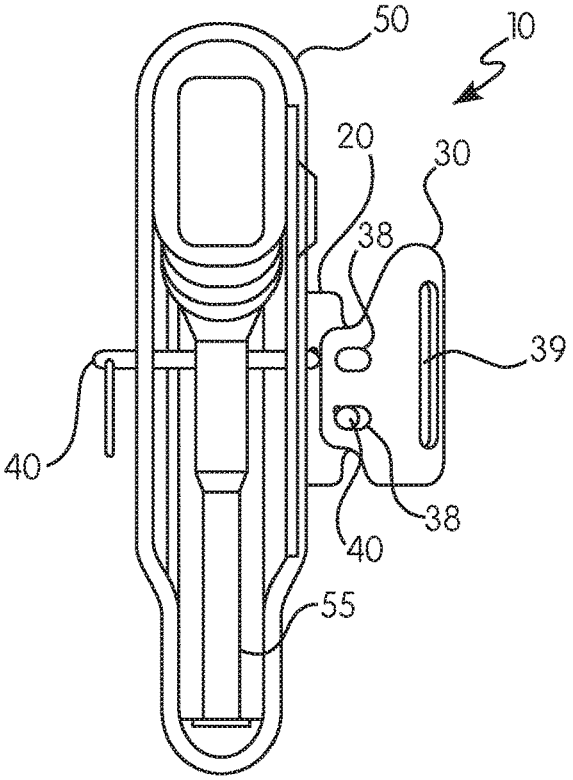
FIG. 7B is front view of the holster assembly of FIG. 7A.
Figure 7C:
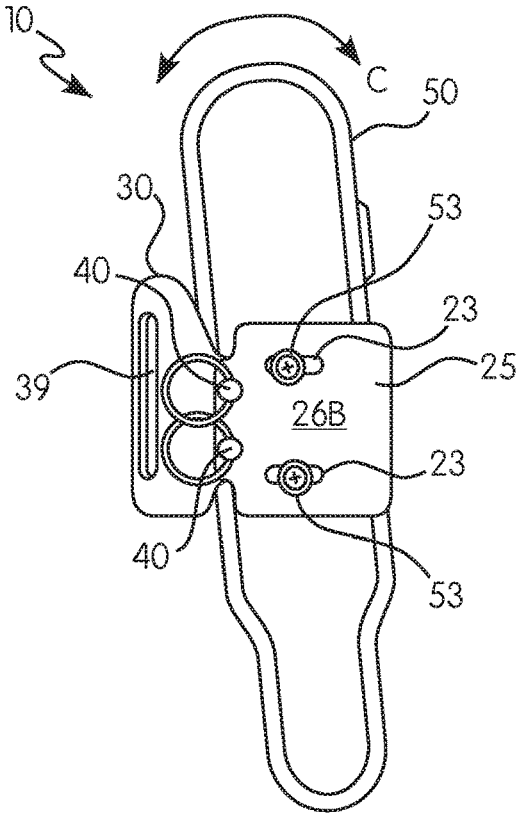
FIG. 7C is a rear view of the holster assembly of FIG. 7A with the shroud positioned in an inward arc configuration.
Figure 7D:
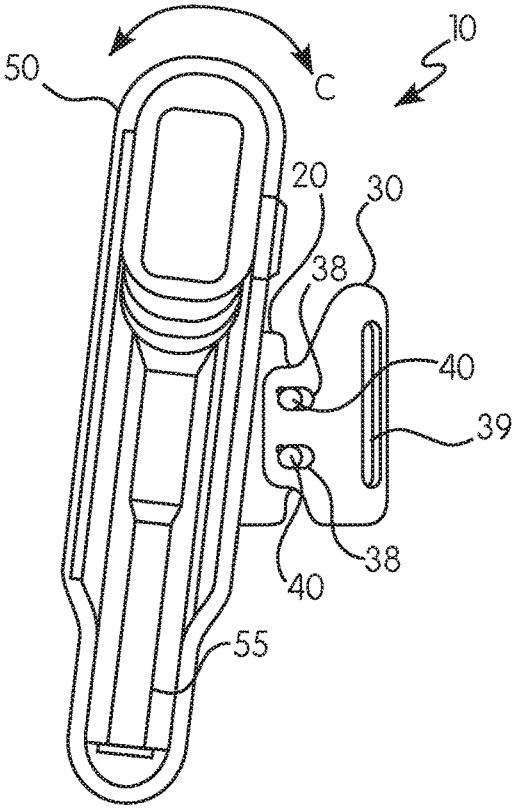
FIG. 7D is a front view of the holster assembly of FIG. 7A with the shroud positioned in an inward arc configuration.
Figure 7E:
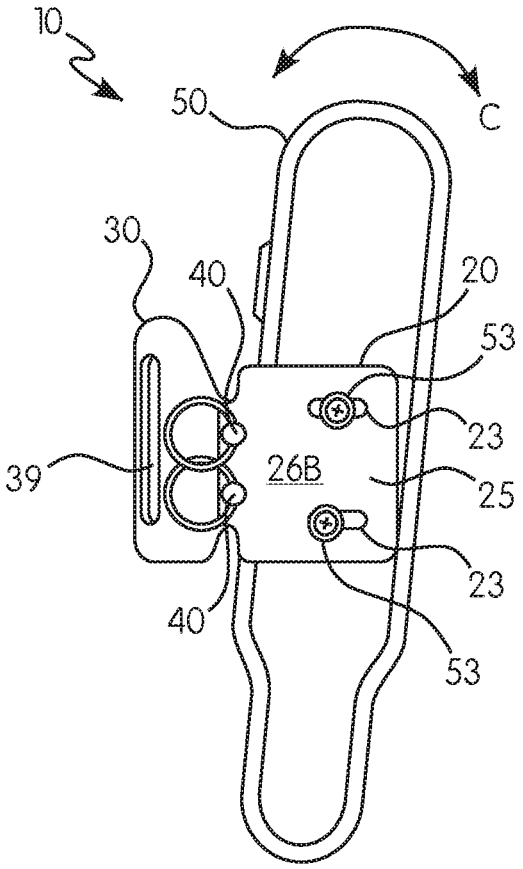
FIG. 7E is a rear view of the holster assembly of FIG. 7A with the shroud positioned in an outward arc configuration.
Figure 7F:
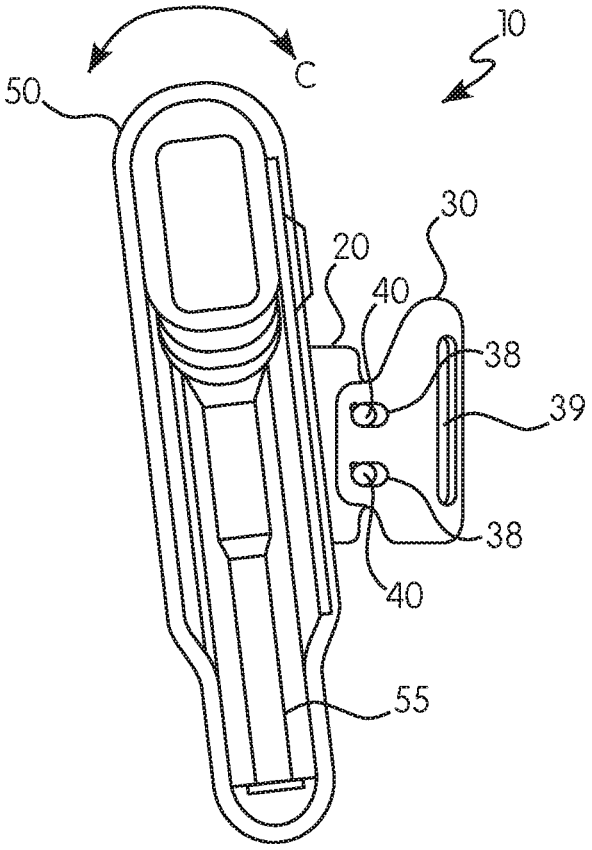
FIG. 7F is a front view of the holster assembly of FIG. 7A with the shroud positioned in an outward arc configuration.
Figure 10:
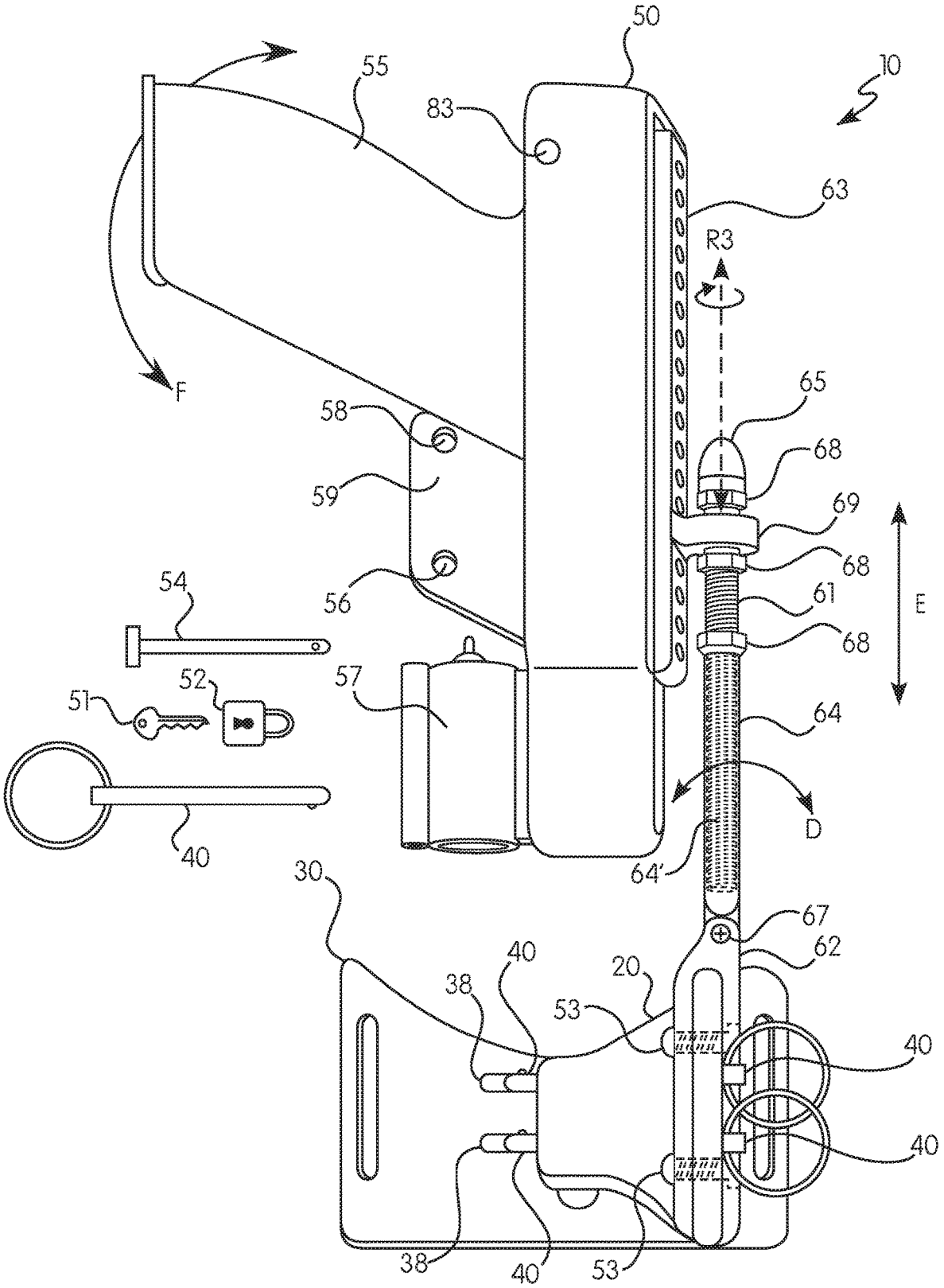
FIG. 10 is a right-side view of another embodiment of a holster assembly with a shroud in an elevated position in a right-side carry configuration.

FIGS. 7A-7F illustrate an embodiment of a holster assembly 10 including a shroud 50 for releasably receiving a firearm 55 in a left-side carry configuration. As such, the use and operation of the holster assembly 10 of FIGS. 7A-7F would be substantially identical to and the mirror image of that shown FIGS. 6A-6F, except that FIGS. 7A and 7B show that one clevis pin 40 may be removed from channel 38 and hole 21 and, thus, engagement with hip plate 30 and mounting bracket 20. The removed clevis pin 40 may then be inserted through shroud 50, such as through a hole defined therethrough, and used as a tactical pin, for example, as a trigger safety guard, such as being positioned behind a trigger, or for securing the pistol in the shroud. A more detailed view of the use of a clevis pin 40 in this manner is illustrated in FIG. 10. Thus, having two or more clevis pins 40 provides the advantage of being able to remove one clevis pin 40, using it for a purpose other than securing the hip plate 30 to the mounting bracket 20, while still maintaining the locking of the mounting bracket 20 to the hip plate 30 in the vertical direction.

Figure 8:
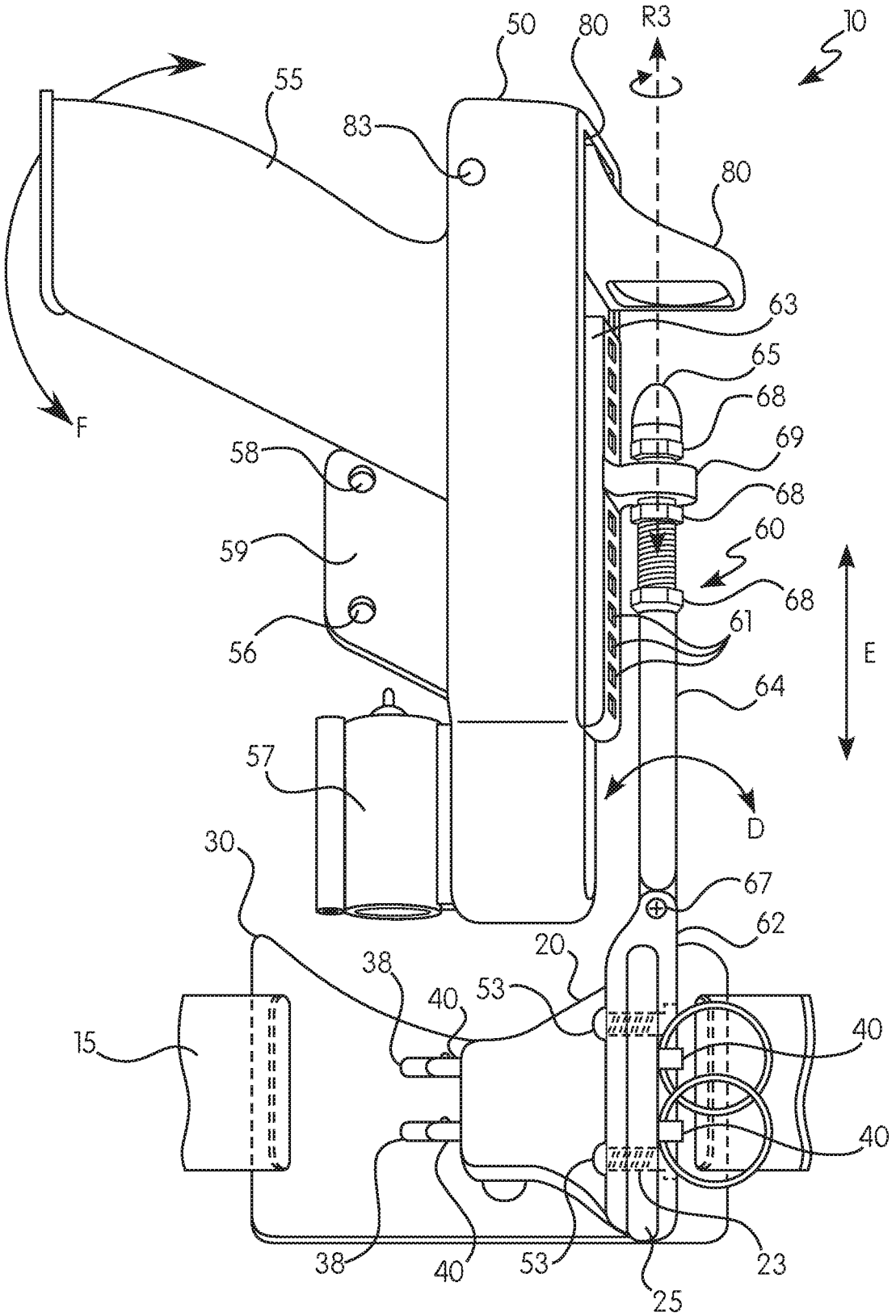
FIG. 8 is a right-side view of an embodiment of a holster assembly with a shroud in an elevated position in a right-side carry configuration.

Referring now to FIG. 8, an embodiment of a holster assembly 10 is shown, including a stanchion mount 60 for positioning the shroud above the hip plate 30 and, preferably, at a height corresponding to a conventional strap-based shoulder holster. The stanchion mount 60, thus, connects to the bracket mount 20 at a first end thereof from which a stanchion rod 64 extends vertically therefrom, and the shroud 50 is secured at a second end of the stanchion rod 64 or mount 60. In particular, however, the stanchion mount 60 includes a stanchion yoke 62 straddling mounting face 25 of mounting bracket 20. The yoke 62 is secured to the mounting face 25 by fasteners 53 extending through the yoke 62 and slots 23 of mounting face 25. Extending upwardly or vertically from and connected to the stanchion yoke 62 is a stanchion rod 64. The stanchion rod 64 is connected to the yoke 62 at a joint via a locking bolt 67 that is configured to permit the stanchion rod 64, and, thus, the whole of the stanchion mount 60 and the shroud 50 to pivot or rotate about the pivot point defined by the joint formed at locking bolt 67 in the direction of arrow D, which, if positioned on a user would be in a forward and/or backward direction. This permits pivoting of the entirety of the stanchion mount 60 and the shroud 50 about an axis of rotation defined by the locking bolt. (See, e.g, broken line R2, FIG. 11 below.) The stanchion rod 64 may be an internally threaded rod (see FIG. 10 at internal threads 64' shown in broken lines) that can threadably engage externally threaded rod screw 66. The threaded engagement of rod screw 66 and stanchion rod 64 permits the length of the stanchion mount 60 and, thus, the height of the shroud 50 to be adjusted in the direction of arrow E. The stanchion mount 60 may further include lock nuts 68, which can lock the threaded rod screw 66 in place with respect to the stanchion rod 64.

The shroud 50 is secured to the threaded rod screw 66 via a support yoke 69, which encircles a portion of the threaded rod screw 66. The portion of the threaded rod screw 66 engaging the yoke 69 may itself be threaded or it may be smooth. In either event, the yoke 69 permits rotation in 360 degrees about the threaded rod screw 66 as indicated by arrow F. Thus, the stanchion threaded rod screw 66 and/or the stanchion rod 64 define an axis of rotation, such as represented by broken line R3. Due to the connection of the shroud 50 to stanchion mount 60, as explained herein more below, the rotation of yoke 69 results in the rotation of shroud 50 in 360 degrees as well. The yoke 69 extends from a stanchion shroud mount 63 which connects directly to shroud 50. The stanchion shroud mount 63 may include a plurality of holes 61, which may include mount screws therein to detachably secure the stanchion shroud mount 63 to the shroud 50. The number of holes 61 and/or screws may vary depending on the firearm's slide length. The screws used may also be removable and replaceable such that the position of the shroud mount 63 could be adjusted on the shroud 50. Additionally, in some embodiments, the yoke 69 may be removably secured to the stanchion shroud mount 63 via the holes 61 either through screws extending from the internal cavity of the shroud through holes 61 and into yoke 69, or through a snap-fit arrangement between yoke 69 and holes 61. In this manner, yoke 69 is adjustable with respect to its vertical position on the shroud 50, and, thus, the shroud 50 is adjustable vertically with respect to the stanchion rod 64 due to the yoke's position thereon. Finally, the stanchion mount 60 may include a securing nut 65 attached to and capping an end of the threaded rod screw 66. The securing nut 65 may be used as a means from securing the yoke 69, and, thus, the shroud 50, at a fixed vertical location on the threaded rod screw 66. The yoke 69 may be, for example, tightened between securing nut 65 and one of lock nuts 68, such that the yoke 69 is secured in its vertical position by adjustment of one of the lock nuts 68, or alternatively another lock nut 68 may be positioned above the yoke 69 to secure yoke 69 between two lock nuts 68. Lock nuts 68 and securing nut 65, thus permit the positioning of shroud 50 with respect to the threaded rod screw to be adjusted. In other words, the yoke 69 may be positioned at any desired position on threaded rod screw 66 by loosening lock nuts 68 and/or securing nut 65, and then it may be rendered releasably stationary with respect to the threaded rod screw 66 by tightening the lock nuts 68/securing nut 65 on either side of the yoke 69.

FIG. 8 also shows a shroud 50 having a trigger guard panel 59. The shroud 50 is also configured such that a laser and/or light aiming module 57, such as a laser sight, may be accessible. Here, the firearm 55 may be outfitted with such a laser and/or light aiming module 57. The module 57 can be attached to or removed from the firearm 55 without removing the firearm 55 from the holster shroud 50, thereby allowing one handed access to the laser and/or light aiming module 57 if it is not needed in conjunction with the firearm 55. Lastly, FIG. 8 includes a shroud hole 80 extending through the shroud 50 for receiving and positioning a firearm sight 85, such as a pistol red dot sight, as illustrated. The red dot sight hole 80 permits a firearm including sight 85 to be mounted in a shroud, such as shroud 50, without having to disengage the sight 85 from the firearm. For example, a pistol may be holstered into shroud 50 in the ways and using the mechanisms shown and described in U.S. Pat. No. 6,755,331 to Rassias and U.S. Pat. No. 8,215,525 to Rassias, both of which are incorporated herein by reference. As such, a pistol is rotated into shroud 50 to securely holster the pistol in shroud 50. The red dot sight hole 80, thus, permits the pistol to be rotated into shroud 50 with the sight 85 being attached thereto, such that the 85 is received in and extend through hole 80.

Figure 9:
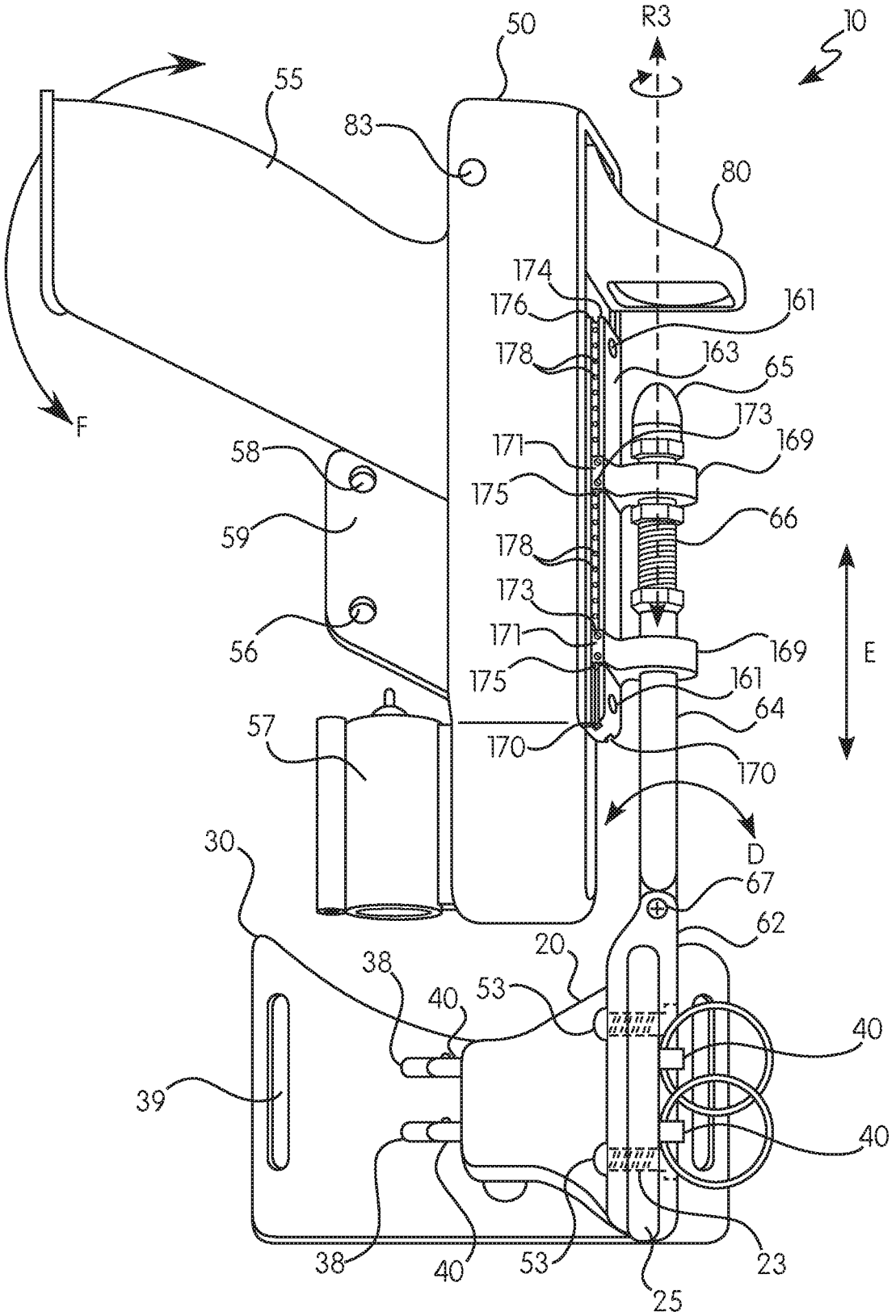
FIG. 9 is a right-side view of another embodiment of a holster assembly with a shroud in an elevated position in a right-side carry configuration.

FIG. 9 shows a substantially identical embodiment to the one illustrated in FIG. 8 in most respects. FIG. 9, however, shows an embodiment of a holster assembly 10 having a doubly supported stanchion shroud mount 163. As illustrated, this embodiment may include two support yokes 169, one at a rearward position and one at a forward position on the stanchion shroud mount 163. What is meant by a rearward and forward position in this context is the rearward and forward position in relation to a firearm secured in the shroud 50 or, in other words, in relation to the orientation of FIG. 9, an upper and lower position. The shroud 50 and yokes 169 still maintain their ability to rotate 360 degrees about threaded rod screw 66, despite that the stanchion shroud mount 163 includes two yokes 169, and one of the yokes 169 is illustrated as being attached to the unthreaded outer surface of a stanchion rod 64. The stanchion shroud mount 163 may also include fasteners 161, such as screws or bolts, for securing the stanchion shroud mount 163 to the shroud 50. As shown, the stanchion shroud mount 163 may be secured with fasteners 161 at both a rearward and forward position relative to the shroud. Another distinguishing feature between the stanchion shroud mount 163 of FIG. 9 and stanchion shroud mount 63 of FIG. 8 is that stanchion shroud mount 163 be key slotted having key slots or channels 170 on the right and left sides of the stanchion shroud mount 163. The stanchion shroud mount 163 includes flange edges 174, 176 extending outwardly from the sides thereby defining channels 170. The yokes 169 include on their bottoms channel engaging members 171 that permit the yokes 169 to be slidably engageable with shroud mount 163 through channels 170. Channel engaging members 171 may include inwardly extending flanges 175 intended to be received in channels 170 in order to ensure that yokes 169 are slidably engageable with shroud mount 163. In this manner, the positioning of yokes 169 is adjustable in a vertical direction, such as indicated by arrow E, with respect to the stanchion shroud mount 163 and, thus, shroud 50. The channels 170 may include holes 178 intended to receive fasteners to secure yokes 169 in position, such as by fasteners 173, such as screws or any other reversibly securable fastener.

FIG. 10, shows another embodiment of a holster assembly 10 including a shroud 50. However, shroud 50 of FIG. 10 does not include a site hole for receiving a firearm site therethrough. The embodiment of FIG. 10 includes trigger guard panel 59, but also shows a trigger guard lock, which as depicted, may include pin 54, which may be a key-lockable tactical locking pin, to be inserted through hole 58 of trigger guard panel 59, and lock 52 and key 51 to secure pin in trigger guard panel 59. However, any trigger guard lock that may fit trigger guard panel 59 is contemplated. As can be appreciated, a correspondence trigger guard panel may be located on the opposite inside side of the shroud, i.e., the part of the shroud closest to the user's body. The pin 54 alternatively may be inserted through hole 83 extending through the rear of the shroud 50 to prevent rotation of the firearm out of the shroud 50. FIG. 10 also illustrates a clevis pin 40 that is insertable through hole 56 of trigger guard panel 59 thereby providing additional tactical functionality, such as further securing the shroud to the firearm, for example, by extending through the firearm trigger guard panel and, optionally behind a trigger, or, alternatively, it may extend through hole 83, like tactical locking pin 54 providing similar functionality. This clevis pin 40 may be an additional clevis pin or it may be one of the already supplied clevis pins 40 securing bracket mount 20 to hip plate 30, but removed from bracket mount 20 and hip plate 30, such as shown in FIGS. 7A-7B. In any event, the firearm could not be removed by any means from the shroud 50 until the pins 40 and/or 54 are removed. Insertion of these pins also allows the shroud 50 to act as a gun safe. It is contemplated that the shroud may be detachable from the stanchion mount 64 and/or the mounting bracket 20 in the above embodiments. Thus, if detached from the rest of the holster assembly 10, the shroud 50 may act as a gun safe such as for overnight or any extended storage when pin 54 is extended through hole 83 and locked with the lock 52.

Figure 11:
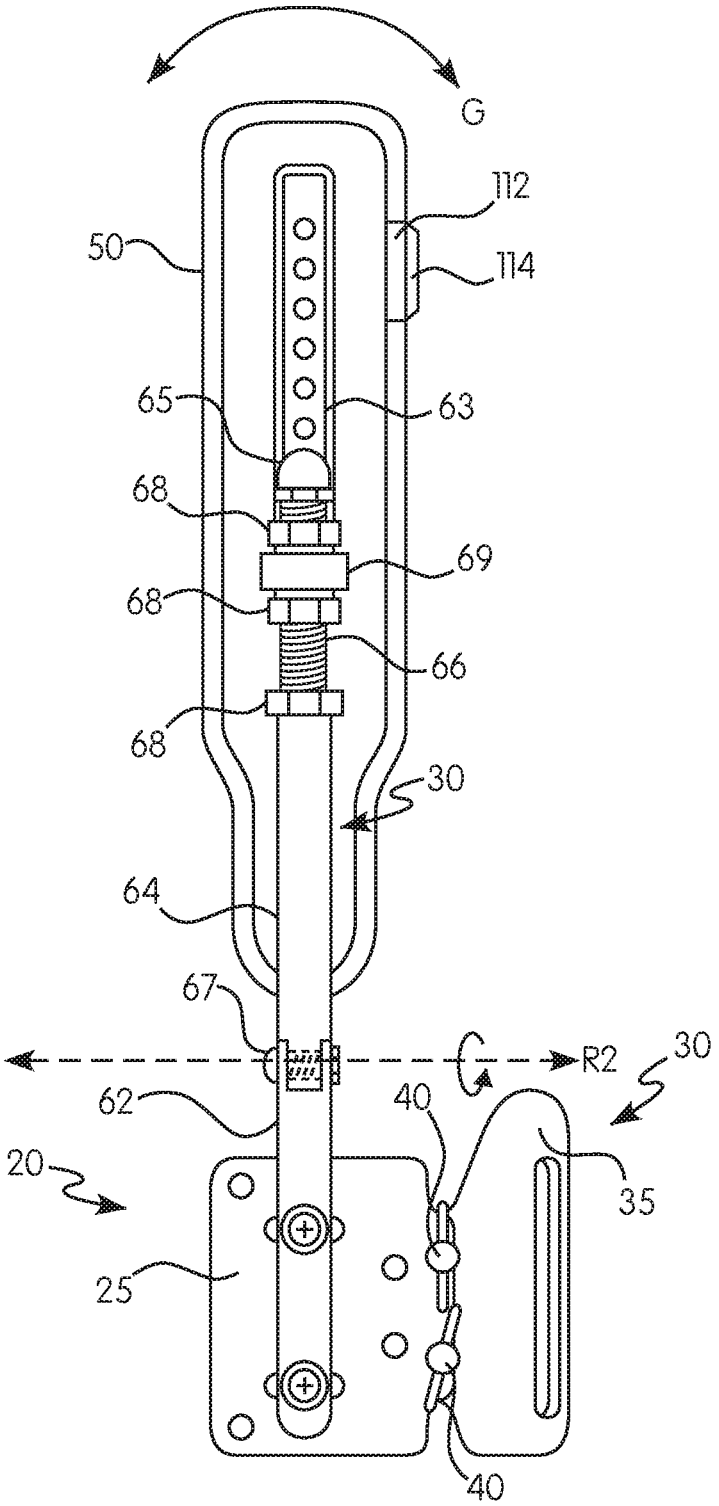
FIG. 11 is a front view of the holster assembly of FIG. 10.

FIG. 11 is a front view of the holster assembly of FIG. 10. FIG. 11 illustrates the pivotable movement of stanchion mount 60 and, thus, shroud 50, in an angular or rotational direction of arrow G. As shown, yoke 62 of stanchion mount 60 is secured to mounting member 25 of bracket mount 20 by fasteners 53 extending through slots 23 of mounting member 25. The fasteners 53 operate in the same way and, thus, may be adjustable and repositioned in virtually identical ways to the fasteners 53 illustrated in FIGS. 6A-7F. The stanchion mount 60, and, thus, shroud 50, may be angularly adjustable about an axis of rotation extending into front face 26B of mounting member 25 and through mounting member 25, such as the axis represented by line R1 in FIG. 5. FIG. 11 also more clearly illustrates the locking bolt 67 and the joint formed at that point between stanchion rod 64 and yoke 62.

In operation, the holster assemblies 10 may be constructed and used in the following manner. A user could slide bracket mount 20 into hip plate 30 in the direction of arrow B of FIG. 5 to engage the slide bracket mount 20 to the hip plate 30 as explained with respect to FIGS. 1-5. A user should then adjust the angle of shroud as shown and described in FIGS. 6A-7F or FIG. 11 about a first axis of rotation, such as R1. The user may then secure that angular position of the shroud through fasteners 53. In some embodiments, the user may then adjust the height of the shroud, such as described in reference to FIG. 8, or such as described with respect to the shroud mount 163 of FIG. 9, in the direction of arrow E. As a result of the height adjustment, shroud 50, as shown, may be positioned entirely above the hip plate 30 and bracket mount 20 at a height that corresponds to a conventional over the shoulders, strap shoulder holster. Instead, however, of being supported by the shoulder of the user, the holster is supported at the hip, thereby provide a holster that serves as a strapless shoulder holster. Additionally, a user may adjust the forward-backward angle of the shroud, such as described in reference to FIGS. 8 and 11, such as pivoting about a second axis of rotation, such as represented by broken line R2 of FIG. 11. Additionally, the shroud may be adjusted rotationally in the direction of arrow F in FIGS. 8-11 about a third axis of rotation defined by the stanchion rod 64 and/or the threaded screw 66 and represented by broken line R3. The various pivoting and rotational movements permitted by the embodiments of the present invention may permit a firearm to be drawn from either hand, regardless of holster positioning, from the locked position. For example, an outward arc position, such as in FIGS. 6E and 6F, or a more forward position, such as securing the stanchion rod at a more forward angle in the direction of arrow D of FIG. 8, may provide easy access for both a user's hands to draw the firearm from the shroud. The adjustments of the shroud positioning according to the present invention permit a user to rotate the holster about multiple axes of rotation into any position that is comfortable for the user. Standard shoulder holsters can make it very difficult to draw the firearm as they tend not to stay in place and hang. They also tend to be difficult to reach for users that are larger in size, obese, muscular, broad shouldered, or broad chested. Thus, the embodiments of the present holster assembly permits users to adjust the holster into a fixed position that is most comfortable and best accessible to the user, as opposed to a hanging, and often moving, position caused by standard shoulder holsters.

Figure 12:
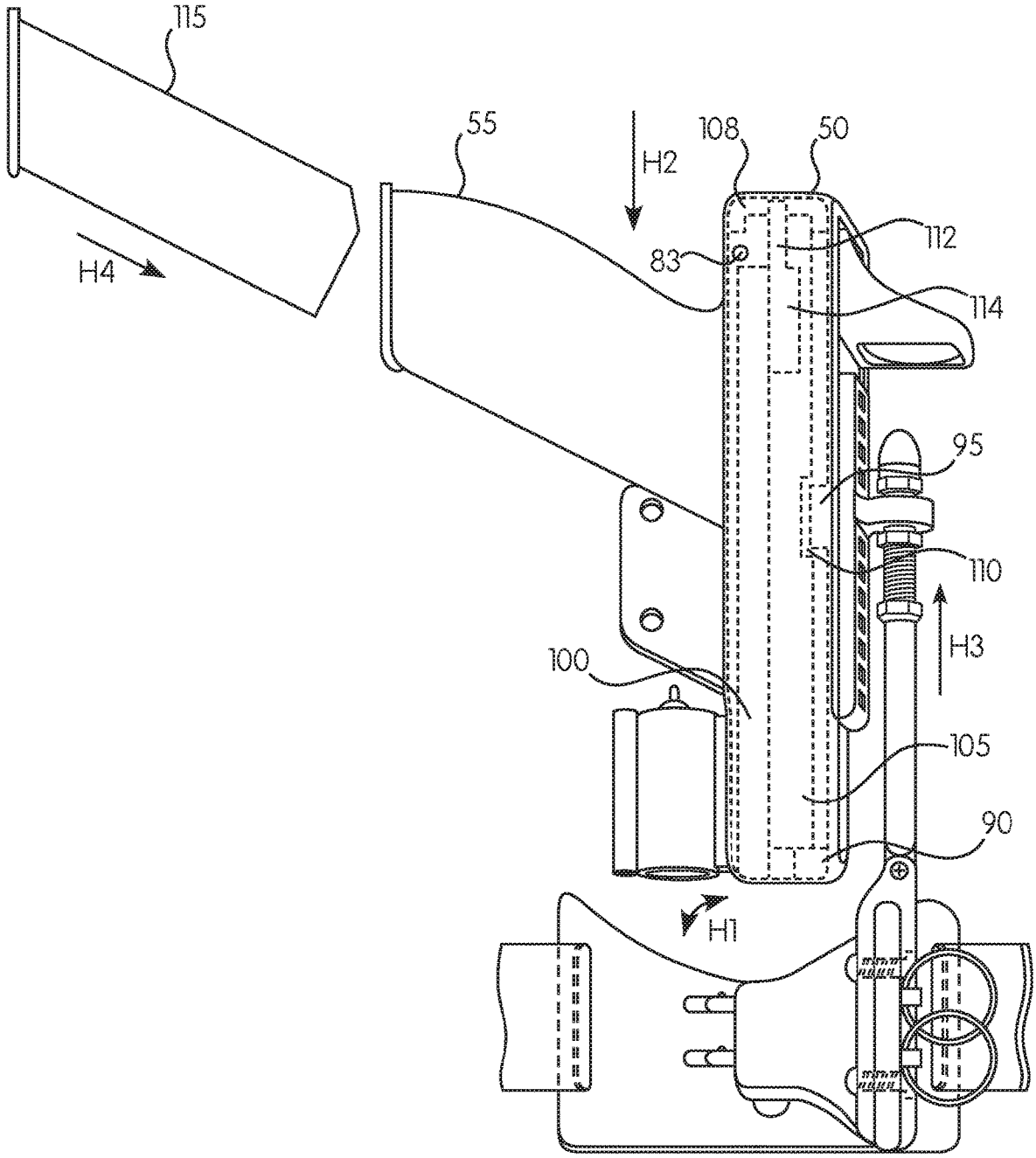
FIG. 12 is a right-side view of an embodiment of a holster assembly showing the holstering technique of a firearm and the holstering locking mechanisms of the holster assembly shroud.

Also facilitating ambidextrous drawing and/or holstering of the present embodiments is the way in which the firearm 55 is actually holstered and drawn from the shroud 50, as opposed to prepositioning or adjusting of the shroud 50 as herein explained above. As explained above, examples of holstering/drawing techniques for shroud 50 are those shown and described in U.S. Pat. No. 6,755,331 to Rassias and U.S. Pat. No. 8,215,525 to Rassias, both of which are incorporated herein by reference and which provide ambidextrous drawing capability. In such embodiments of shroud 50, such as illustrated in FIG. 12, a firearm, such as a pistol 55, may be placed into the holster shroud 50 with a round in the chamber 110 or without. While in the shroud 50, the pistol 55 is slightly out of battery, disengaging the trigger so that the pistol cannot be fired until removed from the shroud. The firearm may be holstered in the shroud 55 by a slight downward and rotational motion by the user as indicated by arrows H2 and H1, respectively. This rotational and downward movement into the shroud 50 causes the chamber 110 to engage with an internal protrusion locking member, such as a blocking boss or locking lug 95, such as disclosed in U.S. Pat. No. 6,755,331 to Rassias and U.S. Pat. No. 8,215,525 to Rassias. For example, the downward motion, such as exerting a downward force on the grip of a pistol 55, such as in the direction of arrow H2, causes the chamber to open, such as shown in FIG. 12. As illustrated, the downward force causes the muzzle end of slide 105 to contact a slide stop 90 at the muzzle end of the shroud 50, which allows the pistol frame or receiver 105 to continue moving in a downward direction thereby opening the chamber 110. The pistol 55 can then be accepted in parallel to the shroud 50 by a rotational movement into the shroud 50 such as in the direction of arrow H1. In some embodiments, merely a one quarter inch turn will accomplish this task. In some embodiments, the muzzle end of the pistol may act as a pivot point. The rotational movement allows the boss or locking lug 95 on the inside of shroud 50 to enter the chamber 110, thereby locking the slide partially open. As downward pressure is released, the action of the pistol partially closes the slide 105 in a direction H3 to a lock partially open breech status and, thus, out of battery. This position, thus, automatically places the pistol in non-fireable status with a trigger disengaged. Some embodiment may optionally include safety locking cams 108 off of the rear of the shroud 50. The safety locking cams 108 can lock under the slide's rails preventing any motion in any direction until a lever 112 is released, for example, with user's thumb. The lever 112 is illustrated in broken lines as it would be on the side opposite the illustrated side of shroud 50 in order to accommodate for a user's thumb, but of course embodiments are envisioned where a lever could be place on the visible side of shroud 50, if desired by the user. The lever 112 is shown more clearly externally in FIG. 11. When the pistol 55 is holstered in the shroud 50 it is thus incapable of moving in any downward, upward, backward, forward, or side motion. An adjustable thumb rest 114 may also be included. It is adjustable to the size and through of the users thumb via set screws or other fastening means. To draw, the safety lever 112 cooperates with safety locking cams 108 and, when it is pushed down, it actuating an internal cam release of safety locking cams 108, wherein the pistol 55 may then be rotated out of the shroud in the direction of arrow H1 by moving the grip end of the pistol out of the holster shroud 50 with the barrel end within the shroud being used as the pivot point. In some embodiments, drawing may require downward pressure or force exerted on the grip in a direction of arrow H2 before rotating out of the shroud. The action of the locking cams 108, lever 112 and thumb rest 114, including adjustability is shown in more detail in U.S. Pat. No. 8,215,525 to Rassias, which is hereby incorporated by reference in its entirety. In some embodiments, the lever 112 may alternatively or additionally actuate the pistol safety, such as shown and described in U.S. Pat. No. 7,850,053 to Rassias, which is hereby incorporated by reference in its entirety. In embodiments not including a safety lever 112, the user merely needs to push down on the grip and rotate the pistol out of the shroud 50. The above actions are equally achievable by both left and right hands, regardless of whether the holster is in a right-side or left-side carry configuration as it is merely a downward and rotational movement required to accomplish these actions and, in some embodiments, the release of a safety lever. In some embodiments, the pistol 55 may be holstered into the shroud 50 without a round chambered and with no magazine. After the pistol 55 is locked into the shroud 50, unloaded and trigger disengaged, a loaded magazine 115 may be inserted into the grip, such as indicated in the direction of H4. Thus, when drawing the pistol 55, pushing down on the grip fully opens the chamber 110, thereby permitting rotations backward to clear the locking lug or boss 95 from the chamber 110. Releasing the downward pressure thus allows the recoil spring to expand, closing the action on a chambered round automatically fed into the bore by the closing action due to the magazine having been inserted after holstering. Accordingly, in some embodiments, with only a short, single-handed motion the shrouds according to embodiments of the present invention may automatically transition the pistol from trigger and pistol locked, Unloaded Condition 3 to Unlocked, Loaded Condition 1, cocked and drawn ready to fire. This may be accomplished in less than a second. In some embodiments, the shroud 50 can be configured so that the locking lug or boss 95 will block any action from movement forward if a round is chambered, thereby disallowing holstering of any loaded firearm.

It is noted that although the embodiments of FIGS. 8-12 are shown in a right-side carry configuration, a left-side carry configuration including the same features as FIGS. 8-12 would simply be mirror images of the right-side carry configuration, given the configuration of the holster assembly 10 as explained herein above (see FIGS. 1-7F).

Figure 13:
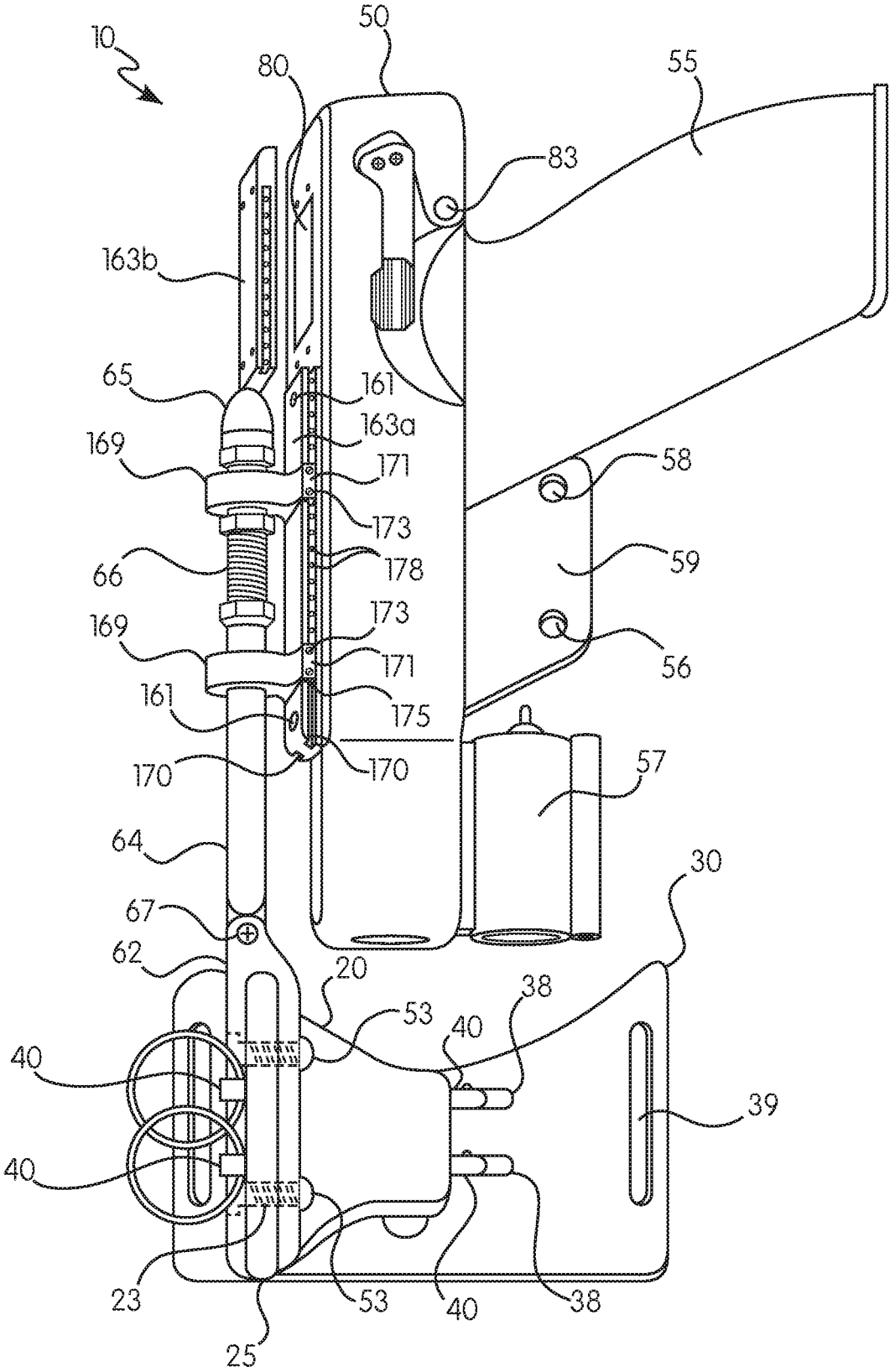
FIG. 13 is a partially exploded right-side view of an embodiment of a holster assembly with a shroud in an elevated position in a left-side carry configuration.
Figure 14:
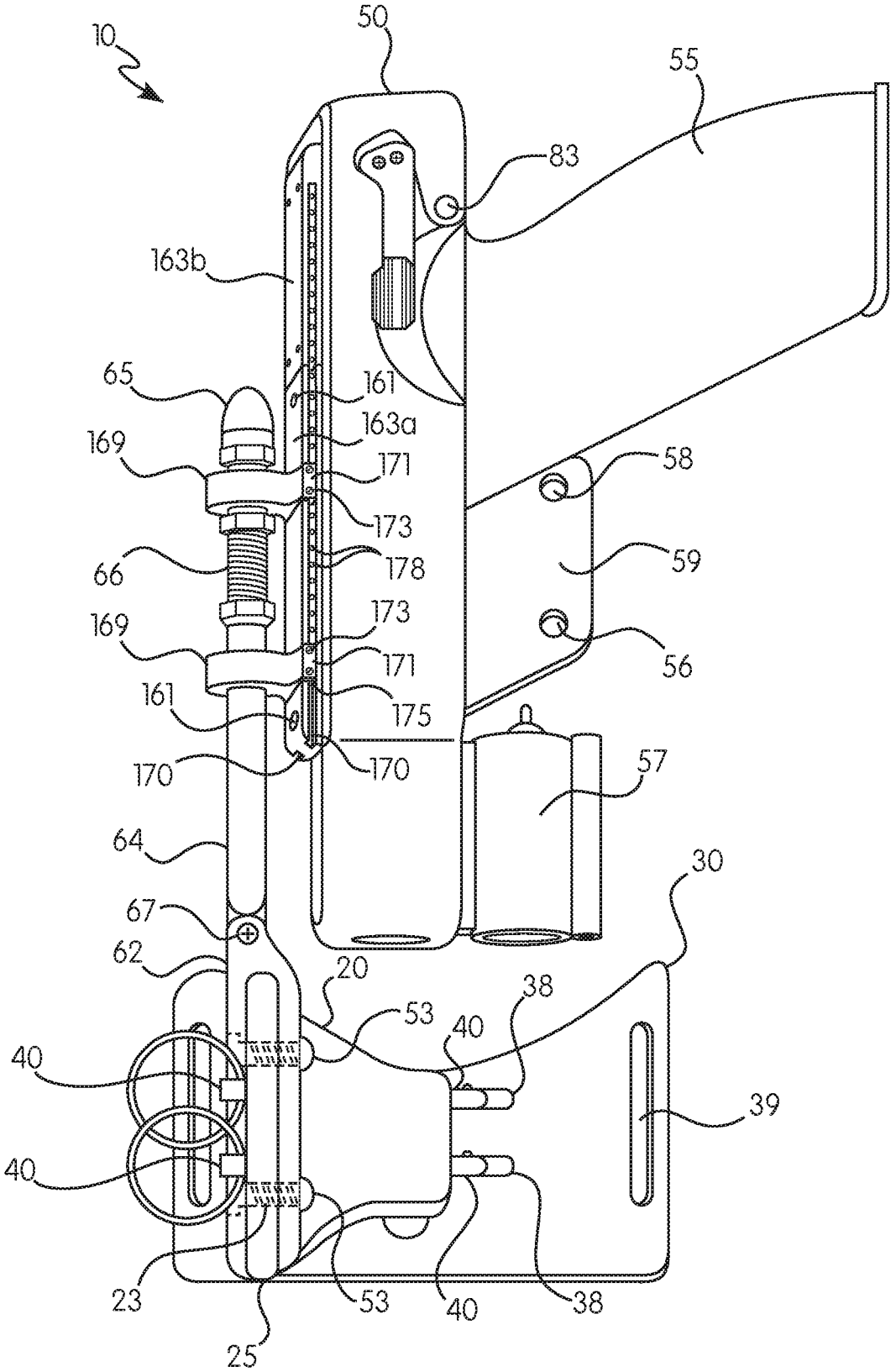
FIG. 14 is a right-side view of the holster assembly of FIG. 13.
Figure 15:
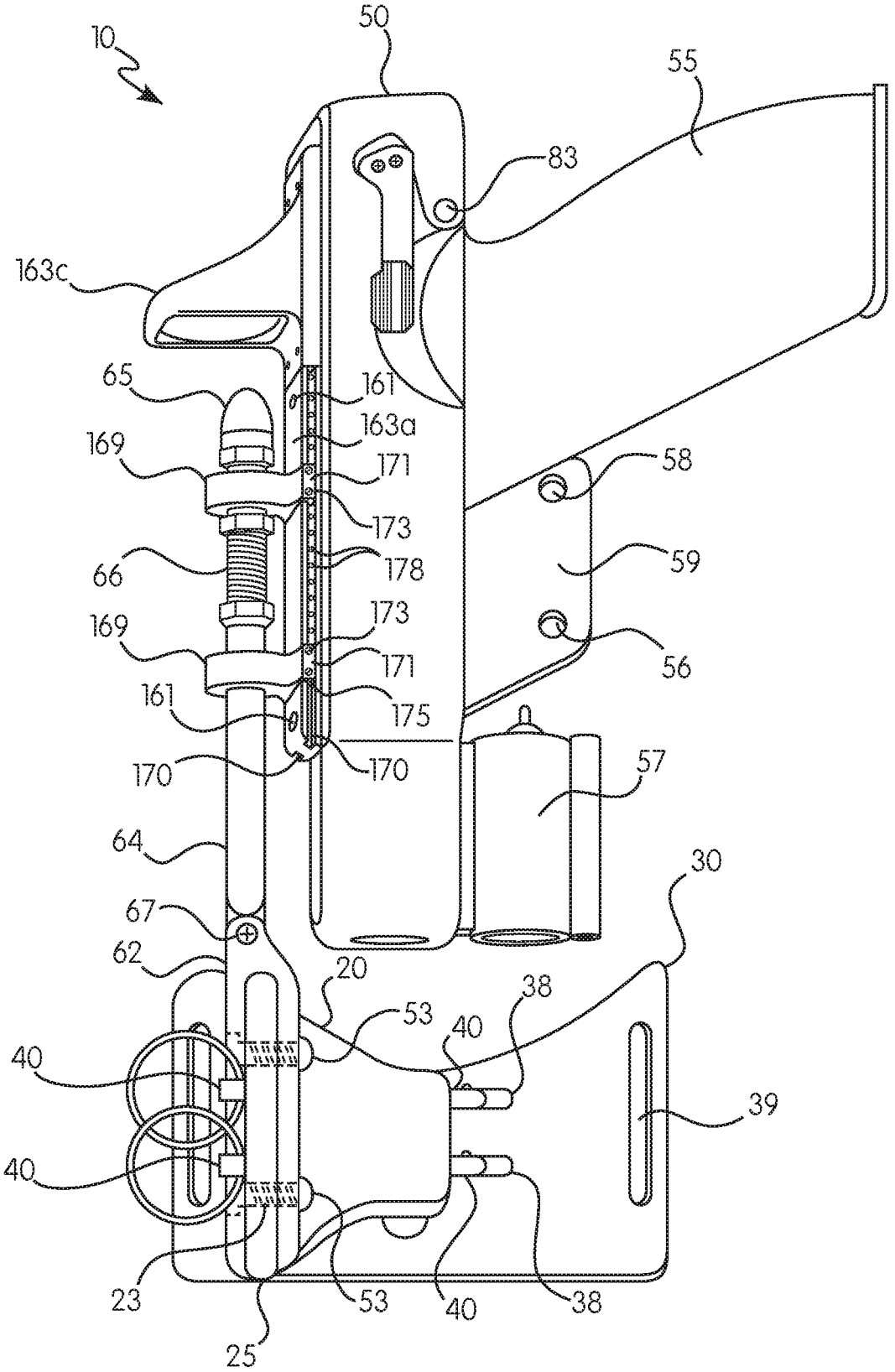
FIG. 15 is a right-side view of an embodiment of a holster assembly with a shroud in an elevated position in a left-side carry configuration.
Figure 16:
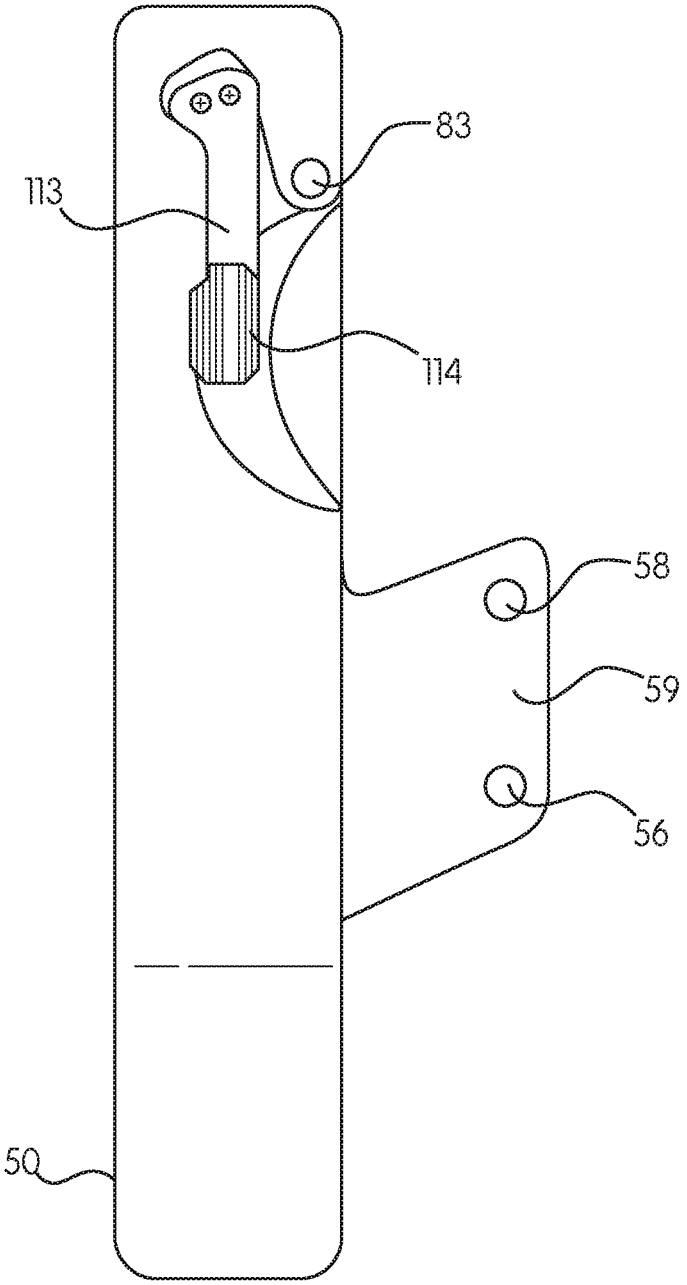
FIG. 16 is a right-side view of an embodiment of a shroud of a holster assembly.

Referring now to FIGS. 13-15, an embodiment of a holster assembly 10 is shown which is similar to the embodiment shown in FIG. 9. Due to the similarities in these embodiments, only the relevant differences will be described hereinafter. FIGS. 13-14 shows a two-piece stanchion shroud mount including a lower portion 163*a* and a removable upper portion 163*b*. The removable upper portion 163*b*, when installed, covers a red dot sight hole 80 of the shroud 50. When the holster assembly 10 is used with a firearm 55 not equipped with a red dot sight, the removable upper portion 163*b* may be secured to the shroud 50, as shown in FIG. 14, via screws, bolts, or the like to prevent dirt, dust, and/or other debris from entering the shroud 50 through the sight hole 80.

When the holster assembly 10 is used with a firearm 55 equipped with a red dot sight, the removable upper portion 163*b* may be replaced with a sight guard 163*c*, as shown in FIG. 15. The sight guard 163*c* may be secured to the shroud 50 in place of, and in like manner as, the removable upper portion 163*b*. For example, the sight guard 163*c* may be secured to the shroud 50, as shown in FIG. 15, via screws, bolts, or the like. The sight guard 163*c* allows a firearm 55 equipped with a red dot sight to be holstered in the holster assembly 10 without the need to attach a separate protective component typically provided with the red dot sight to shield the red dot sight from dirt, dust, and/or other debris. As such, the firearm 55, including the equipped red dot sight, is ready to use immediately upon withdrawal from the holster assembly 10, without the need to remove any additional protective components. Furthermore, the sight guard 163*c* protects the red dot sight while the firearm 55 is holstered in the holster assembly 10 to prevent unintentional jostling and/or misalignment of the red dot sight. Thus, the risk of the red dot sight being misaligned upon withdrawal of the firearm 55 from the holster assembly 10 is reduced or eliminated.

It is noted that although the embodiments of FIGS. 13-15 are shown in a left-side carry configuration, a right-side carry configuration including the same features as FIGS.

13-15 would simply be mirror images of the left-side carry configuration, given the configuration of the holster assembly 10 as explained herein above (see FIGS. 1-7F). Additionally, it is noted that although the lower portion 163*a*, the removable upper portion 163*b*, and the sight guard 163*c* of FIGS. 13-15 have been particularly described as an adaptation of the stanchion shroud mount 163 of FIG. 9, similar adaptations could be made to the stanchion shroud mount 63 of FIGS. 8 and 10-12.

Referring now to FIGS. 16-19C, embodiments of the shroud 50 may include a safety mechanism for retaining the firearm 55 slightly out of battery, disengaging the trigger so that the firearm cannot be fired until removed from the shroud 50. As described above with reference to FIG. 12, the firearm 55 may be holstered in the shroud 50 by a slight downward and rotational motion by the user. This rotational and downward movement into the shroud 50 causes the chamber of the firearm 55 to engage with a pivoting boss 190 to retain the chamber out of battery to prevent accidental discharge of the firearm 55. As with the embodiment described above with reference to FIG. 12, the firearm 55 may be released from the shroud 50 by actuating the lever 112 via the thumb rest 114. Particularly, the lever 112 disengages the locking cam 108 to release the slide 105 of the firearm 55 from the shroud 50. The action of the lever 112, thumb rest 114, and the locking cam 108, including adjustability thereof, is shown in more detail in U.S. Pat. No. 8,215,525 to Rassias, which is hereby incorporated by reference in its entirety.

Figure 17:
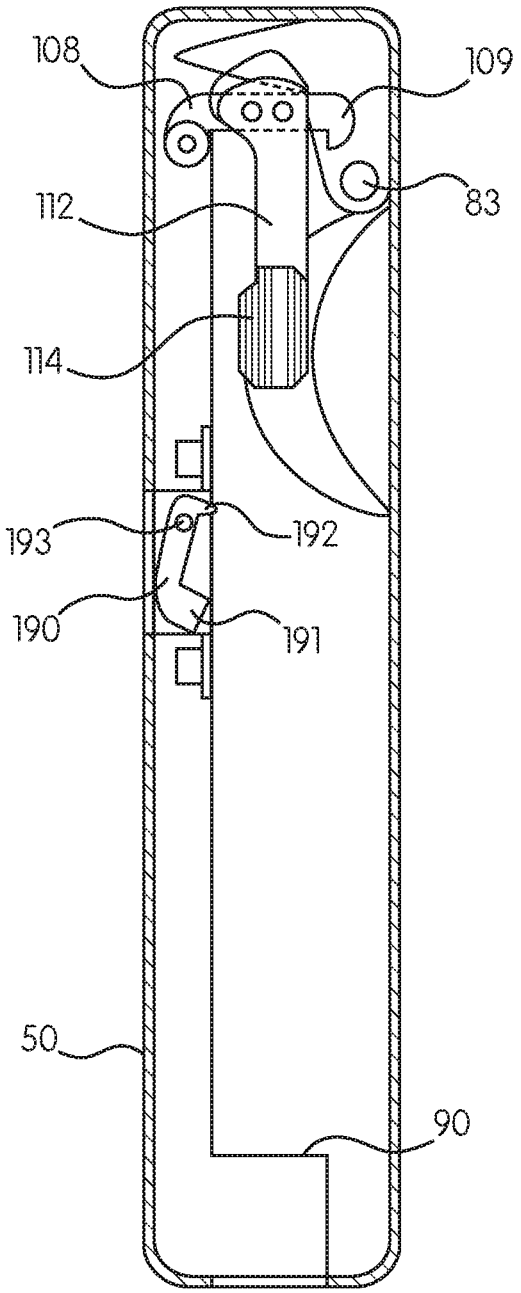
FIG. 17 is a partial cross section view of the shroud of FIG. 16.
Figure 18:
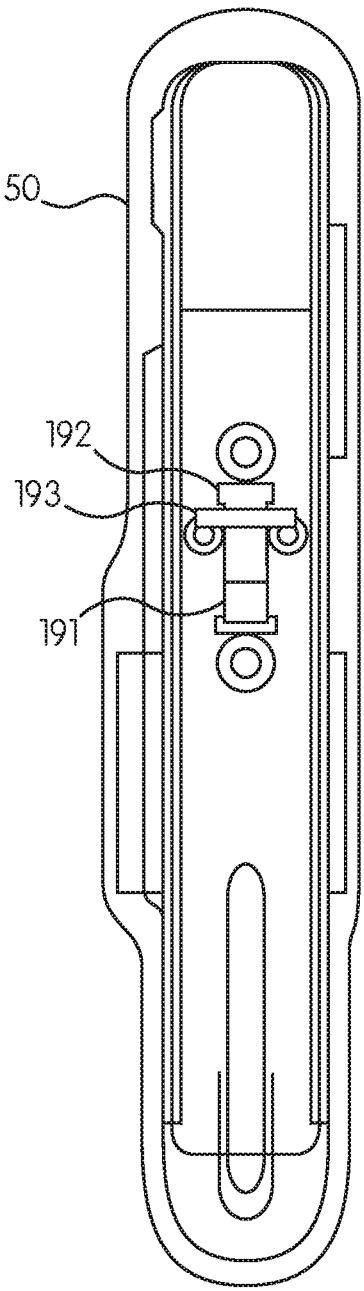
FIG. 18 is a top view of the shroud of FIG. 16.

Referring now to FIGS. 17-18, the pivoting boss 190 includes a first knob 191 for engaging an ejection port 106 of the slide 105 of the firearm 55, and a second knob 192 for abutting a top surface of the slide 105 of the firearm 55. The first knob 191 and the second knob 192 are located on opposite sides of a fulcrum 193, which is secured to the shroud 50 to permit rotation of the pivoting boss 190. In particular, a force applied to the second knob 192 causes movement of the second knob 192 in the direction of the applied force, and also causes movement of the first knob 191 in the opposite direction as the movement of the second knob 192.

Figure 19A:
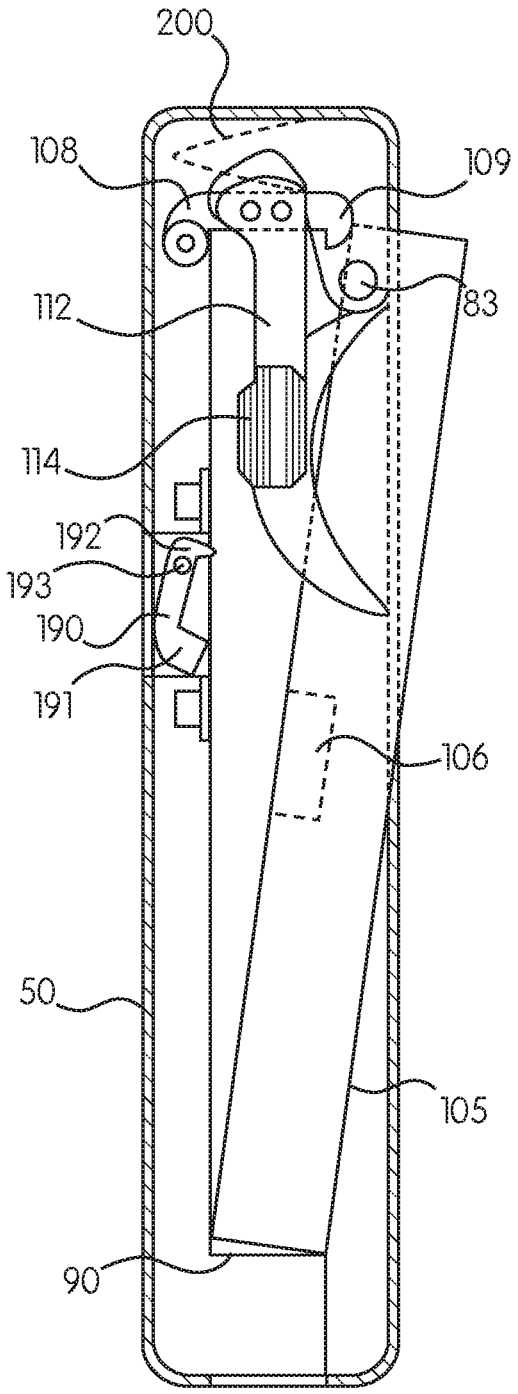
FIG. 19A is a right-side partial cross section view of the shroud of FIG. 16 with a firearm partially holstered.
Figure 19B:
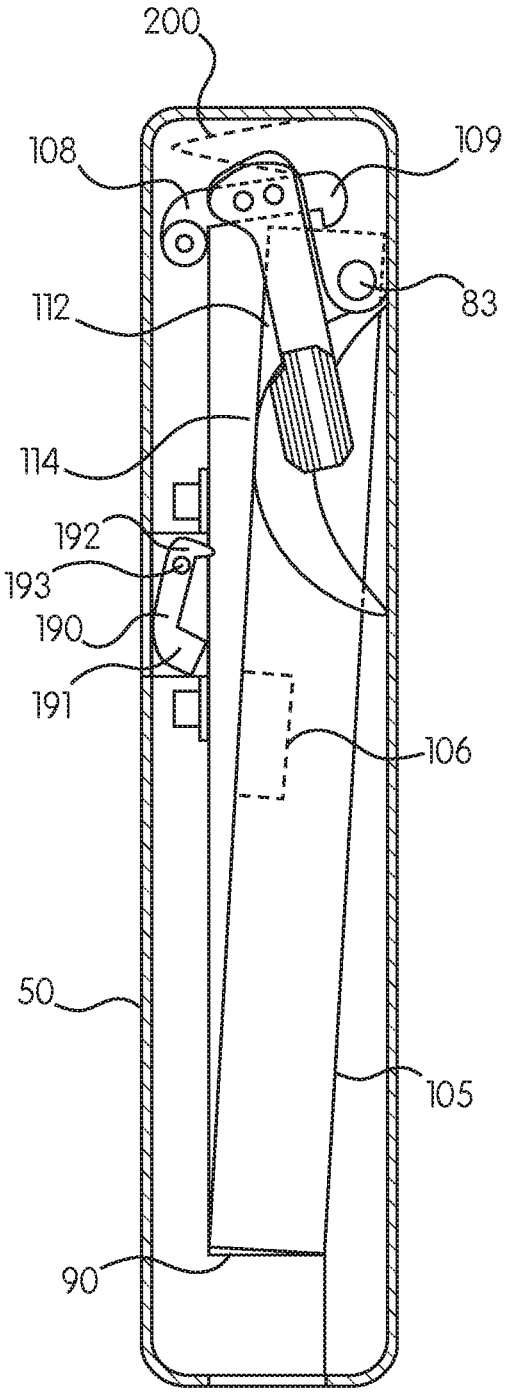
FIG. 19B is a right-side partial cross section view of the shroud of FIG. 16 with a firearm partially holstered.
Figure 19C:
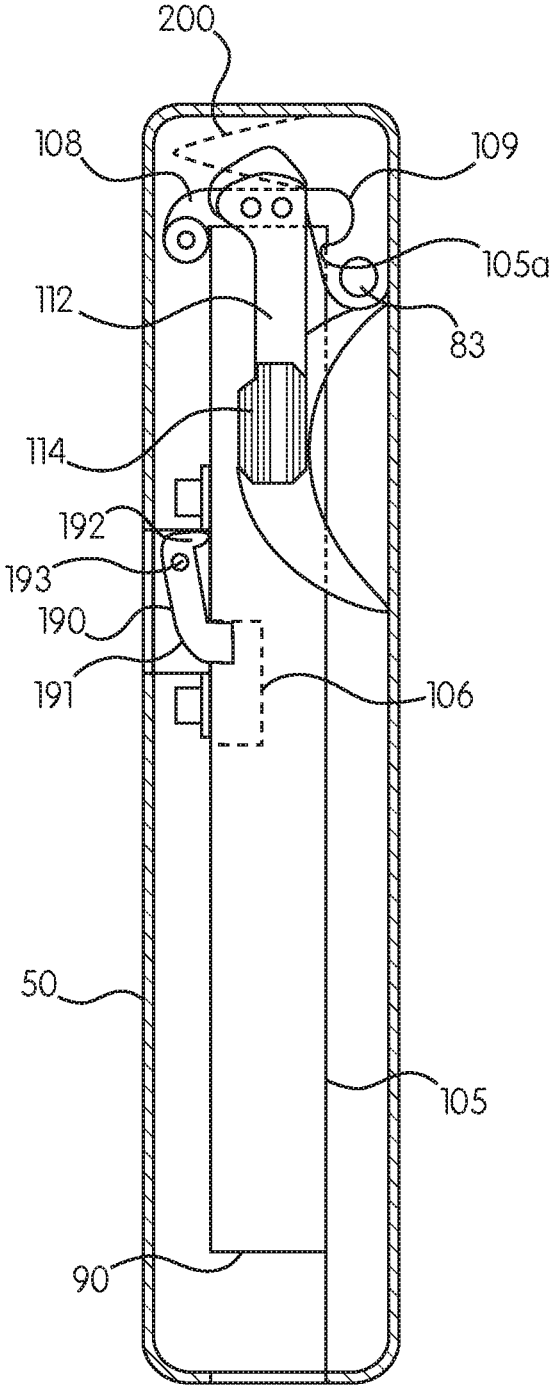
FIG. 19C is a right-side partial cross section view of the shroud of FIG. 16 with a firearm holstered.

FIGS. 19A-19C show a sequence for holstering the firearm 55 in the shroud 50. For clarity and to emphasize the action of the pivoting boss 190 and the locking cam 108, only the slide 105 of the firearm 55 is shown. Referring now to FIG. 19A, the firearm 55 is partially inserted into the shroud 50 at an angle such that the muzzle end of the slide 105 abuts the slide stop 90 of the shroud 50, and the rear end of the slide 105 contacts the locking cam 108. The locking cam 108 has a knob 109 having a generally rounded edge profile where the locking cam 108 contacts the slide 105, such that continued force applied by the user causes the locking cam 108 to be deflected rearward against the bias a spring 200, as shown in FIG. 19B. The spring 200 may be a leaf spring, a coil spring, a torsion spring, or the like disposed between the locking cam 108 and the rear of the shroud 50.

Referring now to FIG. 19B, continued force on the firearm 55 by the user causes the locking cam 108 to deflect rearward until the slide 105 of the firearm 55 clears the knob 109. At the same time, the force applied by the user causes the grip (not shown) of the firearm 55 to move towards the front of the shroud 50, while corresponding frontward movement of the slide 105 is prevented due to abutment of the muzzle end of the slide 105 against the slide stop 90. The resulting translation of the grip relative to the slide 105 causes the chamber of the firearm to move out of battery. As the firearm 55 is unable to fire when the grip and slide 105 are offset and the chamber is out of battery, discharge of the firearm 55 is now impossible even if a round is chambered.

Referring now to FIG. 19C, continued force of the firearm 55 by the user causes the rear end of the slide 105 to rotate into final alignment with the shroud 50. The top surface of the slide 105 abuts the second knob 192 of the pivoting boss 190, causing the pivoting boss 190 to rotate about the fulcrum 193 such that the first knob 191 is rotated into the ejection port 106 of the slide 105. The first knob 191 of the pivoting boss 190 engages the rear edge of the ejection port 106 to prevent the slide 105 from moving relative to the grip, thereby keeping the firearm out of battery. As such, the firearm 55 may be safely carried in the shroud 50 without the risk of accidental discharge. Further, as the slide 105 moves into final alignment with the shroud 50, the rear end of the slide 105 clears the knob 109 of the locking cam 108. The spring 200 biases the locking cam 108 forward such that the knob 109 engages the underside 105*a* of the slide 105, thereby locking the firearm 55 into the shroud 50.

As indicated above, the firearm 55 may be released and removed from the shroud 50 by rotating the lever 112, via the thumb rest 114, to move the knob 109 of the locking cam 108 out of engagement with the slide 105. The firearm 55 may then be removed from the shroud 50 using the opposite motion of insertion. As the firearm 55 is rotated out of the shroud 50, the first knob 191 of the pivoting boss 190 clears the ejection port 106 and the muzzle end of the slide 105 separates from the slide stop 90. The slide 105 is then permitted to translates back into alignment with the grip of the firearm 55 and into battery. The firearm 55 may then be fired as normal.

The materials used for the various components of the embodiments of a holster assembly 10, as described herein, may be any suitable durable material, such as metals, plastics, fiber re-enforced plastics, high density polymer, or other polymer materials. In some embodiments, the components of the holster assemblies may be made of a material that is extremely durable and impervious to heat, cold, and solvents, e.g., high-strength aluminum, ZYTEL, DENDRIL, or other similar high-strength plastic composite. As is appreciated by those skilled in the art, the invention is not limited to such materials used to make the holster assemblies according to embodiments of the present invention.

While the present invention has previously been described with respect to the non-limiting embodiments described herein, it is envisioned that other modifications and additions to the invention hereinbefore described may be made by those skilled in the art without deviating from the spirit of the invention. Accordingly, it is intended that such modifications and additions be included within the scope of the present invention, insofar as set forth in the following claims and equivalents thereof.

The invention claimed is:

1. A holster, comprising:

a hip plate;

a bracket mount detachably engaged with the hip plate;

a shroud for removably receiving a firearm therein and being adjustably connected to the bracket mount, the shroud being angularly adjustable with respect to the bracket mount; and a stanchion rod connected to the bracket mount at a first end and extending vertically upward therefrom, the shroud being connected to the stanchion rod at a second end thereof, such that, in use, the second end of the stanchion rod and at least a portion of the shroud connected thereto have a vertical position with reference to a height of a user between the hip plate and a shoulder of the user.

2. The holster of claim 1, wherein the bracket mount is slidably engaged with the hip plate.

3. The holster of claim 2, wherein the hip plate defines a bracket mount receiving slot, the bracket mount being slidably received within the receiving slot.

4. The holster of claim 3, wherein the bracket mount comprises a tongue, the tongue being slidably received in the receiving slot.

5. The holster of claim 4, wherein the bracket mount tongue comprises a lip, and the hip plate comprises an opposing lip adjacent the receiving slot, the bracket mount tongue lip and the hip plate lip securing the bracket mount to the hip plate in a lateral direction.

6. The holster of claim 1, wherein the bracket mount defines at least one shroud attachment slot, the shroud being secured to the bracket mount by a fastener extending through the shroud attachment slot.

7. The holster of claim 1, wherein the stanchion rod is angularly adjustable with respect to the bracket mount in two directions.

8. The holster of claim 1, wherein the shroud is rotatable about the stanchion rod.

9. The holster of claim 1, wherein the stanchion rod is adjustable in length.

10. A strapless shoulder holster comprising:

a hip mount;

a shroud for removably receiving a firearm therein and secured to and positioned above the hip mount, wherein the shroud is angularly adjustable about three axes of rotation with respect to the hip mount; and a stanchion rod connected at opposite ends to the hip mount and shroud, respectively, such that, in use, an end of the stanchion rod and at least a portion of the shroud connected thereto have a vertical position with reference to a height of a user between the hip mount and a shoulder of the user.

11. The strapless shoulder holster of claim 10, wherein the shroud is axially moveable along one of the three axes of rotation.

12. The strapless shoulder holster of claim 10, wherein the shroud is secured to the hip mount through a mounting bracket that is detachably engaged with the hip mount.

13. The strapless shoulder holster of claim 11, further comprising a stanchion rod extending upward from the mounting bracket, wherein the shroud is axially adjustable and releasably securable with respect to the stanchion rod.

14. The strapless shoulder holster of claim 12, wherein the shroud is attached to and rotatable about a stanchion rod extending vertically from and being secured to the mounting bracket, the stanchion rod being pivotable about the mounting bracket in two directions.

15. The strapless shoulder holster of claim 14, wherein the stanchion rod is adjustable in length.

16. The strapless shoulder holster of claim 15, wherein the stanchion rod comprises an internally threaded rod member defining a threaded internal channel, and an externally threaded screw at least partially inserted into the threaded internal channel and threadably engaged with the internally threaded member therein.

17. The strapless shoulder holster of claim 16, wherein the shroud is rotatably attached to the externally threaded screw.

18. The strapless shoulder holster of claim 14, wherein the shroud is secured to the stanchion rod via at least one yoke encircling the stanchion rod, the yoke being attached to a stanchion shroud mount that is adjustably and releasably secured to the shroud.

19. The strapless shoulder holster of claim 18, wherein the stanchion shroud mount comprises longitudinally extending side channels slidably receiving an inwardly extending flange extending from the yoke.

20. The strapless shoulder holster of claim 18, wherein the stanchion shroud mount comprises:

a lower portion; and an upper portion removable from the shroud independently of the lower portion, wherein the upper portion is configured to cover a sight hole in the shroud.

21. The holster of claim 1, wherein the shroud comprises:

a pivoting boss protruding internally in the shroud, the pivoting boss having a first knob configured to engage an open chamber of a firearm inserted into the shroud, a second knob configured to abut the slide of the firearm, and a fulcrum secured to the shroud and located between the first knob and the second knob.

22. The holster of claim 21, wherein the first knob of the pivoting boss is configured to engage an edge of an ejection port of the slide of the firearm.

23. The holster of claim 21, wherein the shroud further comprises a locking cam configured to engage an underside of the slide of the firearm as the first knob of the pivoting boss engages the open chamber of the firearm.

24. The strapless shoulder holster of claim 10, wherein the shroud comprises:

a pivoting boss protruding internally in the shroud, the pivoting boss having a first knob configured to engage an open chamber of a firearm inserted into the shroud, a second knob configured to abut the slide of the firearm, and a fulcrum secured to the shroud and located between the first knob and the second knob, wherein the pivoting boss is configured to rotate about the fulcrum such that, as the firearm is inserted into the shroud, contact between the slide of the firearm and the second knob of the pivoting boss causes the first knob of the pivoting boss to engage the open chamber of the firearm.

* * * * *